US007207958B2

(12) United States Patent
Dehli

(10) Patent No.: US 7,207,958 B2
(45) Date of Patent: Apr. 24, 2007

(54) AIR CONTROLLED MASSAGE SYSTEM WITH MOTORIZED DRIVE MECHANISM

(75) Inventor: Hans Dehli, Dana Point, CA (US)

(73) Assignee: Interactive Health, LLC., Long Beach, CA (US)

( * ) Notice: Subject to any disclaimer, the term of this patent is extended or adjusted under 35 U.S.C. 154(b) by 385 days.

(21) Appl. No.: 10/751,031

(22) Filed: Jan. 2, 2004

(65) Prior Publication Data

US 2005/0101892 A1 May 12, 2005

Related U.S. Application Data

(63) Continuation-in-part of application No. 10/705,412, filed on Nov. 10, 2003.

(51) Int. Cl.
*A61H 19/00* (2006.01)

(52) U.S. Cl. ..... 601/148; 601/149

(58) Field of Classification Search ..... 601/97–103, 601/105, 115–116, 118, 122, 126–127, 136, 601/149, 148

See application file for complete search history.

(56) References Cited

U.S. PATENT DOCUMENTS 5,056,505 A 10/1991 Warwick et al.
5,741,218 A * 4/1998 Fujii ..... 601/90
6,056,707 A * 5/2000 Hayashi ..... 601/99
6,312,400 B1 * 11/2001 Itikawa et al. ..... 601/100
6,315,744 B1 * 11/2001 Inaba ..... 601/149
6,916,300 B2 7/2005 Hester et al.

OTHER PUBLICATIONS

PCT International Search Report dated Oct. 20, 2005, Application No. PCT/US04/37271.

* cited by examiner

*Primary Examiner*—Michael A. Brown
(74) *Attorney, Agent, or Firm*—Christie, Parker & Hale, LLP.

(57) ABSTRACT

A massage system is provided that includes a motor having an output shaft and at least one sliding block connected to the output shaft. The massage system also includes at least one bellows. Each bellows is connected to a corresponding one of the sliding blocks and is moveable between an extended position and a retracted position. When each bellows is moved from the extended to the retracted position air is expelled from the bellows. Similarly, when each bellows is moved from the retracted to the extended position air is taken into the bellows. Operation of the motor causes each sliding block to move between a first position and a second position, such that in the first position each sliding block compresses a corresponding one of the bellows to the retracted position and in the second position each sliding block releases said corresponding one of the bellows to the extended position.

31 Claims, 18 Drawing Sheets

AIR CONTROLLED MASSAGE SYSTEM WITH MOTORIZED DRIVE MECHANISM

CROSS-REFERENCE TO RELATED APPLICATION

This application is a continuation-in-part of U.S. patent application Ser. No. 10/705,412, filed on Nov. 10, 2003.

FIELD OF THE INVENTION

The present invention relates generally to an air supply device for use in a massaging apparatus, such as a massaging chair.

BACKGROUND OF THE INVENTION

A recent improvement to massaging devices is the use of inflatable bladders. In use, the inflatable bladders are repeatedly inflated and deflated to produce a massaging effect when placed next to a person's body. Massaging devices that incorporate inflatable bladders generally produce smoother, more gentle massages than other massaging devices.

However, in some inflatable bladder massaging devices the massaging motion produced by the inflatable bladders is undesirably slow due to the time required for the inflation and subsequent deflation of the inflatable bladders. Accordingly, a need exists for an improved inflatable bladder massaging device and/or an improved air supply device for use in an inflatable bladder massaging device.

SUMMARY

In one embodiment, the present invention is a massage system is includes a motor having an output shaft and at least one sliding block connected to the output shaft. The massage system also includes at least one bellows. Each bellows is connected to a corresponding end of the sliding blocks and is moveable between an extended position and a retracted position. When each bellows is moved from the extended to the retracted position air is expelled from the bellows. Similarly, when each bellows is moved from the retracted to the extended position air is taken into the bellows. Operation of the motor causes each sliding block to move between a first position and a second position, such that in the first position each sliding block compresses a corresponding one of the bellows to the retracted position and in the second position each sliding block releases said corresponding one of the bellows to the extended position.

In another embodiment, the present invention is a massage system that includes a motor having an output shaft and at least one sliding block. Each sliding block is movable between a first position and a second position. The massage system also includes at least one bellows. Each bellows is connected to a corresponding end of the sliding blocks and is moveable between an extended position and a retracted position. When each bellows is moved from the extended to the retracted position air is expelled from the bellows. Similarly, when each bellows is moved from the retracted to the extended position air is taken into the bellows. The at least one sliding block includes a first sliding block and the at least one bellows includes a first bellows and a second bellows each connected to the first sliding block. A first bearing is eccentrically mounted on the output shaft of the motor, such that operation of the motor causes the first bearing to rotate about a substantially elliptically shaped slot in the first sliding block, causing the first sliding block to move between the first and second positions. When the first sliding block is in the first position the first bellows is in the retracted position and the second bellows is in the extended position. When the first sliding block is in the second position the first bellows is in the extended position and the second bellows is in the retracted position.

In yet another embodiment, the present invention is In another embodiment, the present invention is a massage system that includes a motor having an output shaft and at least one sliding block. Each sliding block is movable between a first position and a second position. The massage system also includes at least one bellows. Each bellows is connected to a corresponding one of the sliding blocks and is moveable between an extended position and a retracted position. When each bellows is moved from the extended to the retracted position air is expelled from the bellows. Similarly, when each bellows is moved from the retracted to the extended position air is taken into the bellows. The at least one sliding block includes a first sliding block and the at least one bellows includes a first bellows and a second bellows each connected to the first sliding block. Operation of the motor causes a first cam on the cam shaft to rotate about a substantially elliptically shaped slot in the first sliding block, causing the first sliding block to move between the first and second positions. When the first sliding block is in the first position the first bellows is in the retracted position and the second bellows is in the extended position. When the first sliding block is in the second position the first bellows is in the extended position and the second bellows is in the retracted position.

BRIEF DESCRIPTION OF THE DRAWINGS

Novel features and advantages of the present invention will be better understood by reference to the following detailed description when considered in conjunction with the accompanying drawings wherein.

DETAILED DESCRIPTION OF THE INVENTION

Figures 1A, 1B:
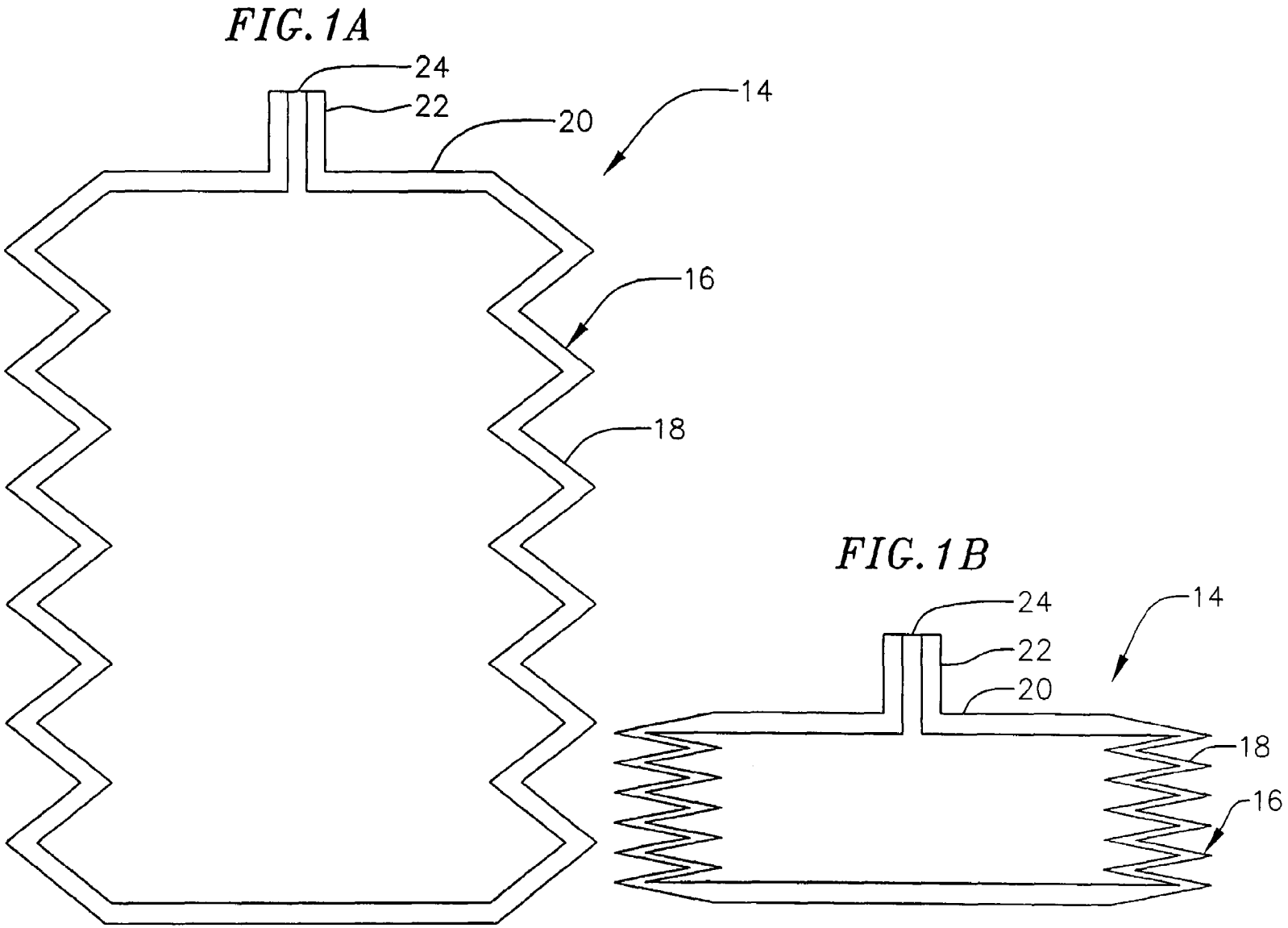
FIG. 1A is a longitudinal cross sectional view of a bellows for use in an air supply system according to the present invention, wherein the bellows is shown in an extended position.
FIG. 1B is a longitudinal cross sectional view of the bellows of FIG. 1A, wherein the bellows is shown in a retracted position.

As shown in FIGS. 1A–14, the present invention is directed to an air supply system 10 that includes a motor 12 and at least one bellows shaped body 14 (hereinafter referred to simply as a "bellows"). Operation of the motor 12 causes each bellows 14 to move between an extended position (FIG. 1A) and a retracted position (FIG. 1B), such that when the bellows 14 is moved from the retracted position to the extended position, the bellows 14 fills with air and when the bellows 14 is moved from the extended position to the retracted position, the bellows 14 expels air. Each bellows 14 includes a sidewall 16 having one or more ridges 18. In the depicted embodiment, the sidewall 16 includes six ridges 18, although in other embodiments the sidewall 16 may include any suitable number of ridges 18. The ridges 18 are collapsible to allow the bellows 14 to move between the extended and retracted positions. Connected to the sidewall 16 is an upper wall 20. The upper wall 20 is connected to a conduit 22 having an opening 24 that allows for the entering and exiting of air into and out of the bellows 14.

Figure 2A:
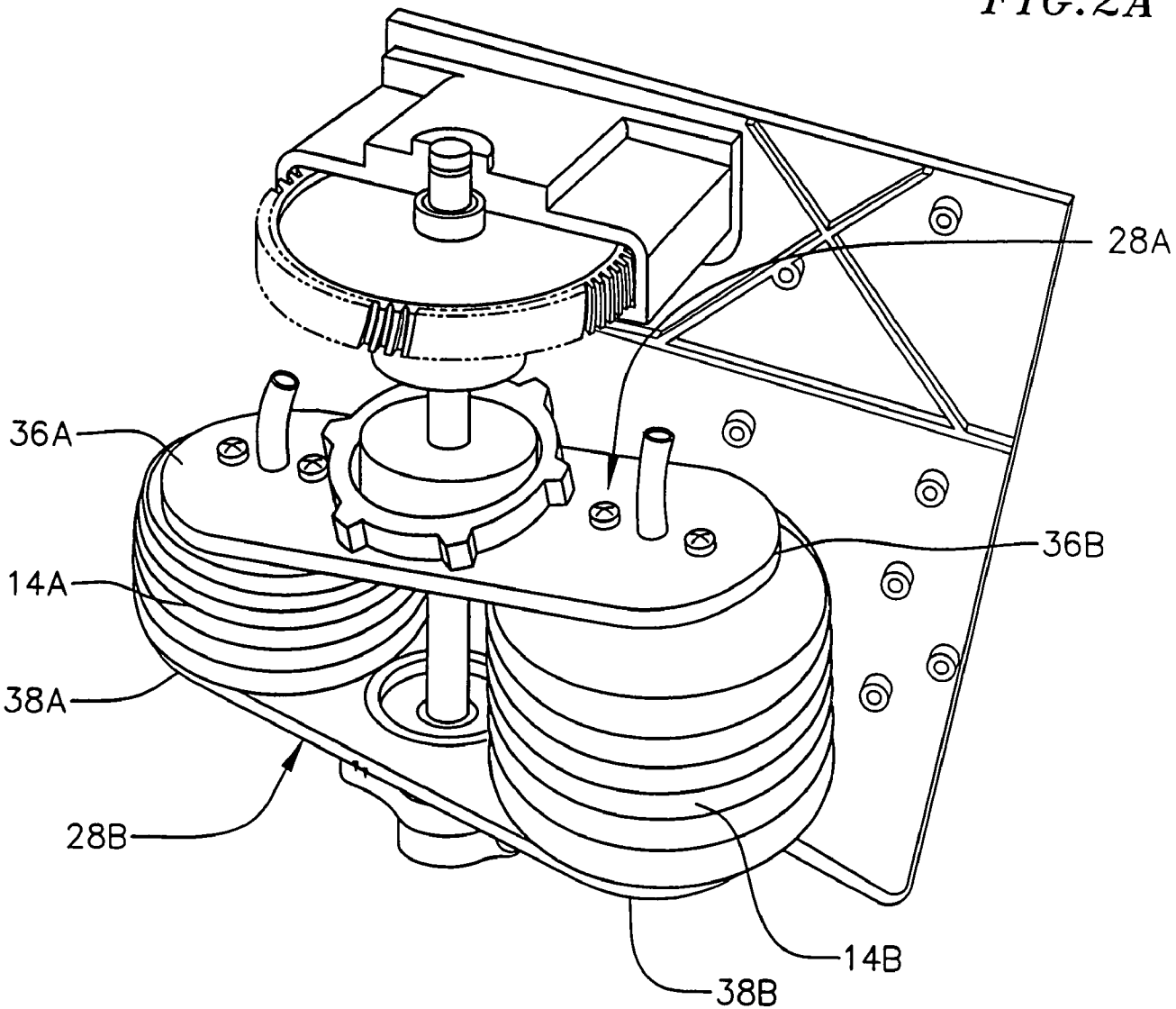
FIG. 2A is a perspective view of a two bellows air supply system, showing a first bellows in a retracted position and a second bellows in an extended position.
Figure 2B:
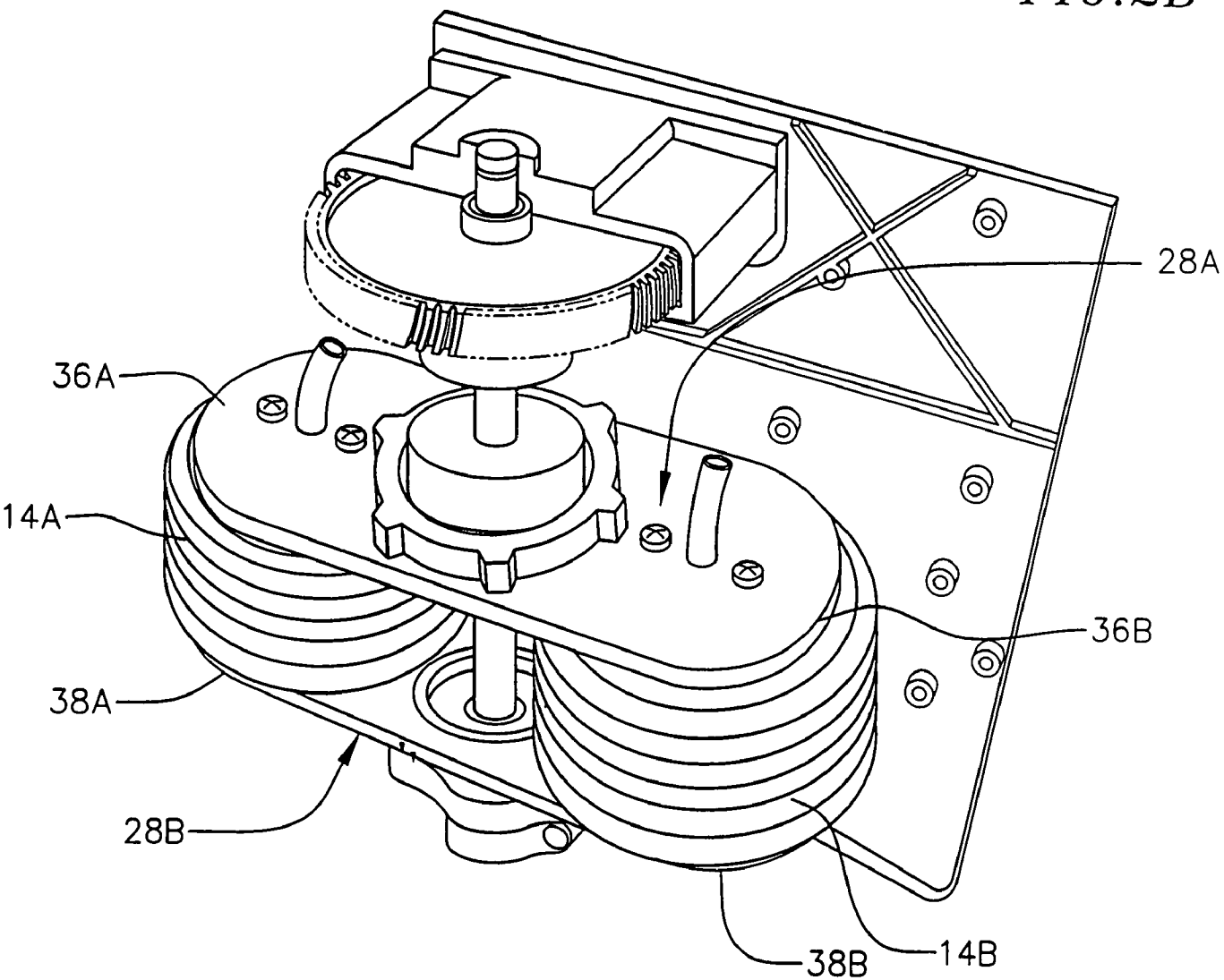
FIG. 2B is another perspective view of the two bellows air supply system of FIG. 2A, showing the first and second bellows in partially retracted positions.
Figure 2C:
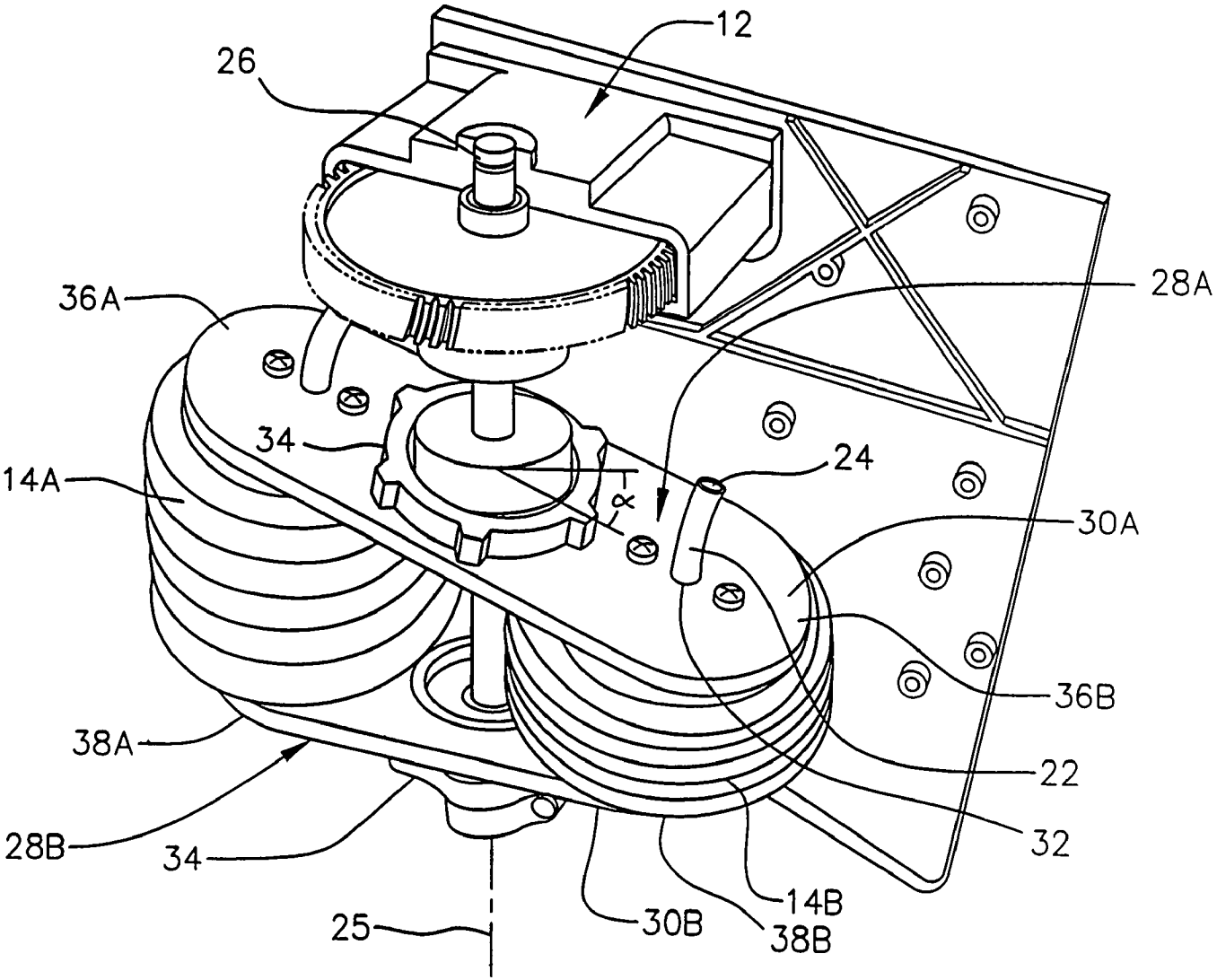
FIG. 2C is another perspective view of the two bellows air supply system of FIG. 2A, showing the first bellows in an extended position and the second bellows in a retracted position.

FIGS. 2A–2C show an air supply system 10 according to one embodiment of the invention. As shown, the air supply system 10 includes a first bellows 14A, a second bellows 14B and a motor 12. As explained in detail below, operation of the motor 12 causes each bellows 14A;14B to move between the extended (FIG. 1A) and retracted positions (FIG. 1B).

The motor 12 includes an output shaft 26. Operation of the motor 12 causes the output shaft 26 to rotate in either a clockwise or counterclockwise direction. For example, in one embodiment the motor 12 is connected to a control panel (not shown) that allows a user to select between a clockwise or a counterclockwise operation of the motor 12.

Connected to the output shaft 26 is an upper plate 28A and a lower upper plate 28B. The terms "right", "left", "upper", "lower", "upward"and "downward" as used herein are relative terms and do not necessarily denote the actual position of an element. For example, an "upper" member may be located lower than a "lower" member.

In the depicted embodiment, each plate 28A;28B is mounted to the output shaft 26 of the motor 12 through a connector 34. Preferably, the connector includes a plurality of ball bearings that facilitates load transfers between the plates 28A;28B and the output shaft 26. Each connector 34 is oriented at an angle $\alpha$, offset from a perpendicular orientation with respect to a longitudinal axis 25 of the output shaft 26. In such an arrangement, when the output shaft 26 rotates, the connector 34 (and hence the plate 28A;28B to which the connector 34 is connected) wobbles about the longitudinal axis 25 of the output shaft 26. By wobbling it is meant that the plate 28A;28B moves both longitudinally (upward and downward) and slightly laterally (side to side) with respect to the longitudinal axis 25 of the output shaft 26. As explained in detail below, the longitudinal movement of the plates 28A;28B causes the bellows 14A;14B to move between the extended and retracted positions.

By varying the offset angle $\alpha$, the longitudinal movement of the plate 28A;28B with respect to the longitudinal axis 25 of the output shaft 26 can be increased or decreased. For example, increasing the offset angle $\alpha$ increases the longitudinal movement of the plate 28A;28B. Similarly, decreasing the offset angle $\alpha$ decreases the longitudinal movement of the plate 28A;28B. In one embodiment, the offset angle $\alpha$ is in the range of approximately 3 degrees to approximately 35 degrees although the range may vary based on design choice. In the depicted embodiment, the offset angle $\alpha$ is approximately 10 degrees.

In one embodiment, the upper and lower plates 28A;28B wobble in opposite synchronization, meaning that for each point on the upper and lower plates 28A;28B, when a point on the upper plate 28A reaches its maximum upward longitudinal position a longitudinally aligned point on the lower plate 28B reaches its maximum downward longitudinal position (and vice versa).

In the depicted embodiment, each bellows 14A;14B is mounted between the upper and lower plates 28A;28B. For example, each bellows 14A;14B may have an upper end 30A mounted to the upper plate 28A and a lower end 30B mounted to the lower plate 28B. In such an arrangement, the longitudinal movement of the plates 28A;28B causes the bellows 14A;14B to move between the extended and retracted positions. FIGS. 2A–2C illustrate this movement.

FIG. 2A shows a left end 36A of the upper plate 28A at its maximum downward longitudinal position and a left end 38A of the lower plate 28B at its maximum upward longitudinal position. This positioning of the plates 28A;28B causes the first bellows 14A to be compressed to its retracted position. FIG. 2A also shows a right end 36B of the upper plate 28A at its maximum upward longitudinal position and a right end 38B of the lower plate 28B at its maximum downward longitudinal position. This positioning of the plates 28A;28B causes the second bellows 14B to be pulled to its extended position.

As the air supply system 10 moves from the illustration shown in FIG. 2A to the illustration shown in FIG. 2B, the left end 36A of the upper plate 28A moves longitudinally upward while the left end 38A of the lower plate 28B moves longitudinally downward, thus causing the first bellows 14A to be pulled to a partially retracted position. At the same time, the right end 36B of the upper plate 28A moves longitudinally downward while the right end 38B of the lower plate 28B move longitudinally upward, thus causing the second bellows 14B to be compressed to a partially retracted position.

As the air supply system 10 moves from the illustration shown in FIG. 2B to the illustration shown in FIG. 2C, the left end 36A of the upper plate 28A continues to move longitudinally upward until it reaches its maximum upward longitudinal position, while the left end 38A of the lower plate 28B continues to move longitudinally downward until it reaches its maximum downward longitudinal position. When so positioned, the plates 28A;28B cause the first bellows 14A to be pulled to its extended position. At the same time, the right end 36B of the upper plate 28A continues to move longitudinally downward until it reaches its maximum downward longitudinal position, while the right end 38B of the lower plate 28B continues to move longitudinally upward until it reaches its maximum upward longitudinal position. When so positioned, the plates 28A;28B cause the second bellows 14B to be compressed to its retracted position.

In the depicted embodiment, the upper plate 28A includes openings 32 for the insertion of the conduits 22 of the first and second bellows 14A;14B. As previously discussed, each conduit 22 has an opening 24 that allows for the entering and exiting of air into and out of its corresponding bellows 14A;14B. As such, when the plates 28A;28B are moved together to compress the bellows 14A;14B to the retracted position, air exits the bellows 14A;14B through the opening 24 in the conduit 22.

Although the above description of FIGS. 2A–2C describes the air supply system 10 as having a movable upper and lower plates 28A;28B, an alternative embodiment includes a moveable upper plate and a stationary lower plate or vice versa. However, because the moveable plates 28A;28B described above move both longitudinally and slightly laterally, in embodiments that include a moveable upper plate and a stationary lower plate or vice versa, the lateral movement of the movable plate causes the upper end 30A of each bellows 14 to move relative to the lower end 30B of each bellows 14. This relative movement causes each bellows 14 to wear and increase the risk of rupturing the sidewall 16 of the bellows 14.

By contrast, when both plates 28A;28B are moveable and wobble in opposite synchronization (as described above), the lateral movement of one plate 28A;28B mimics the lateral movement of the other plate 28B;28A and hence there is little to no relative movement of the upper end 30A of each bellows 14 with respect to the lower end 30B of each bellows 14.

Figure 3A:
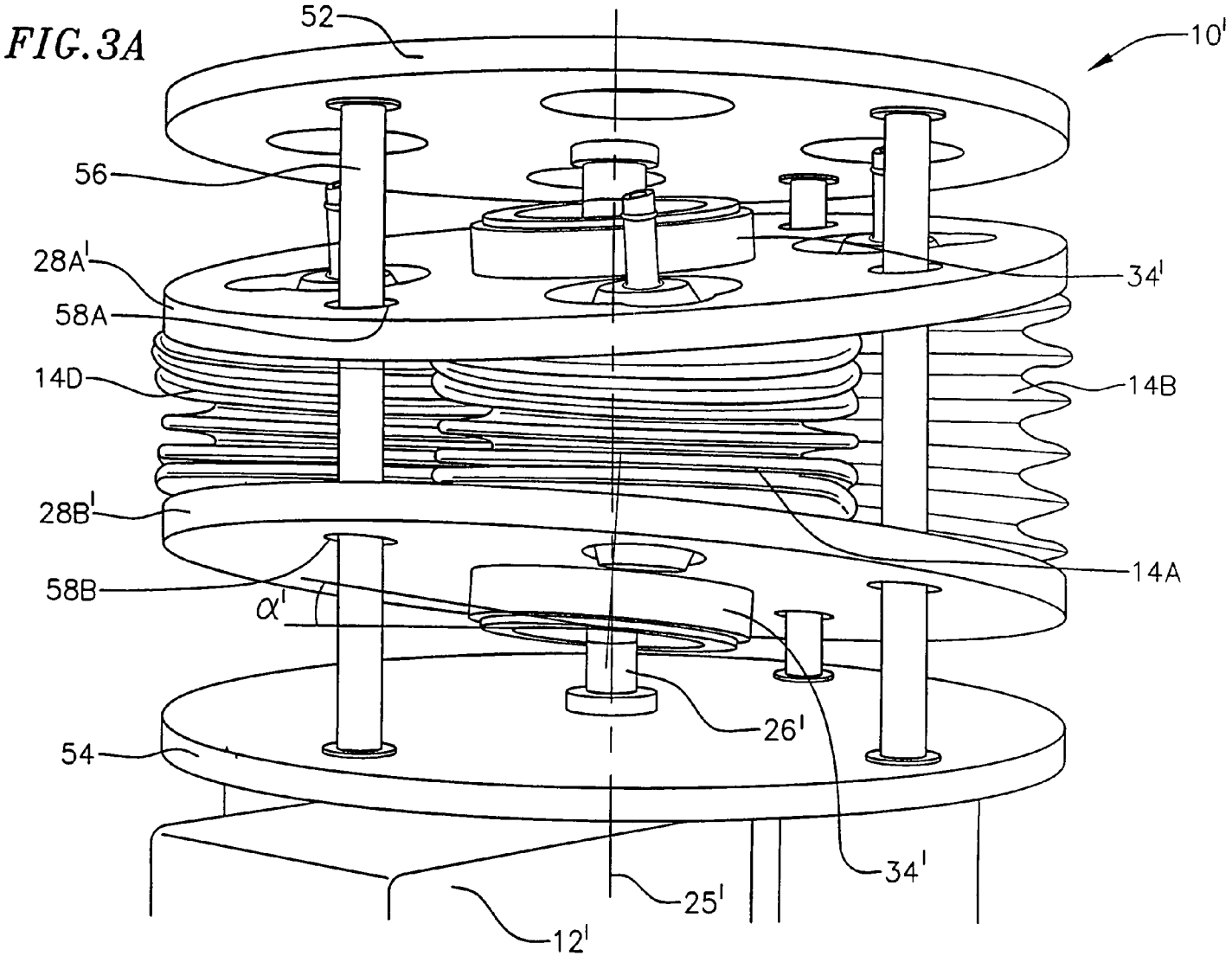
FIG. 3A is a perspective view of a four bellows air supply system, showing a first bellows in a retracted position and two adjacent bellows in partially retracted positions, although not shown, a bellows laterally opposed from the first bellows is in an extended position.
Figure 3B:
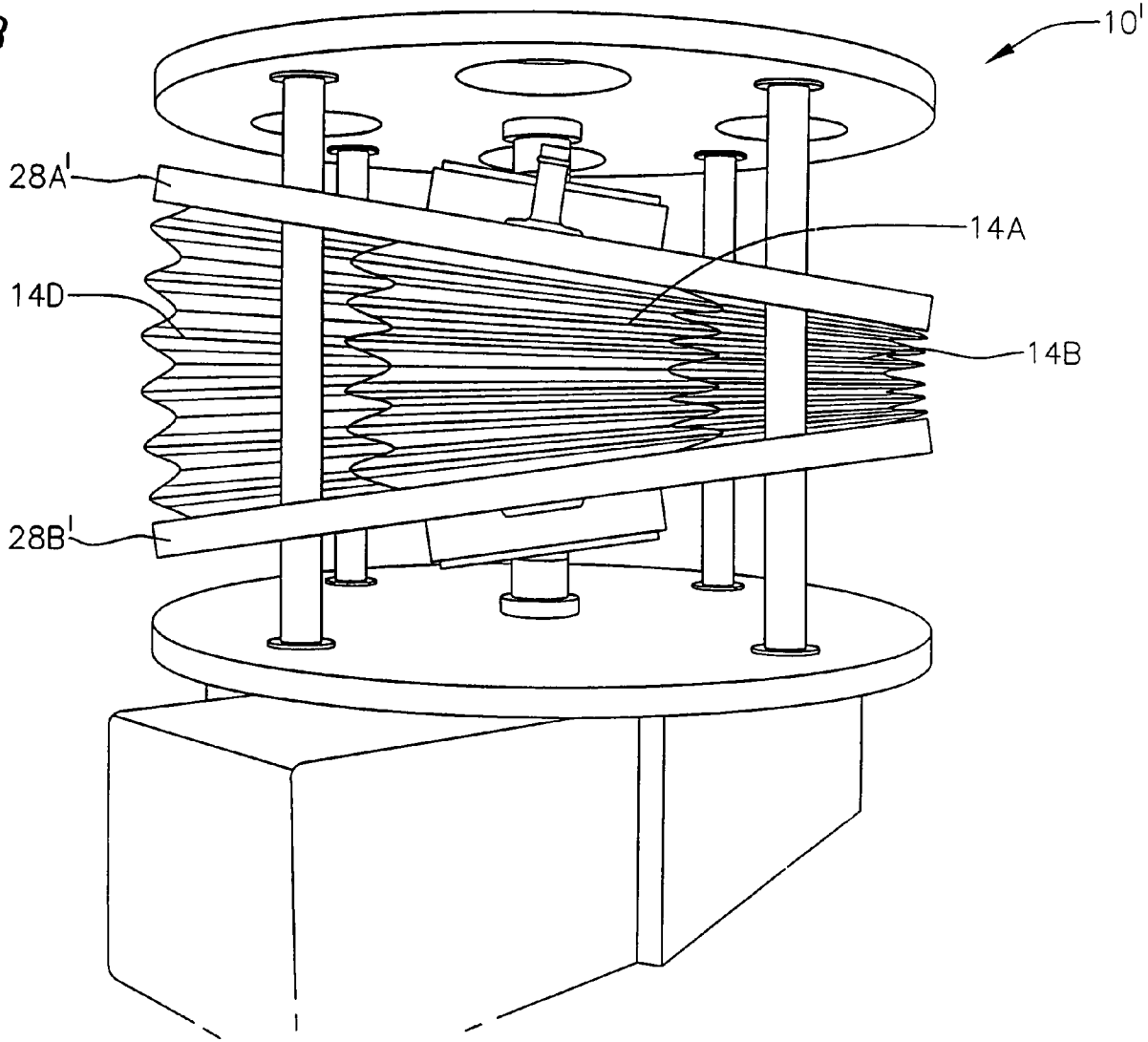
FIG. 3B is another perspective view of the four bellows air supply system of FIG. 3A, showing the first bellows in an extended position and two adjacent bellows in partially retracted positions, although not shown, the bellows laterally opposed from the first bellows is in a retracted position.
Figure 3C:
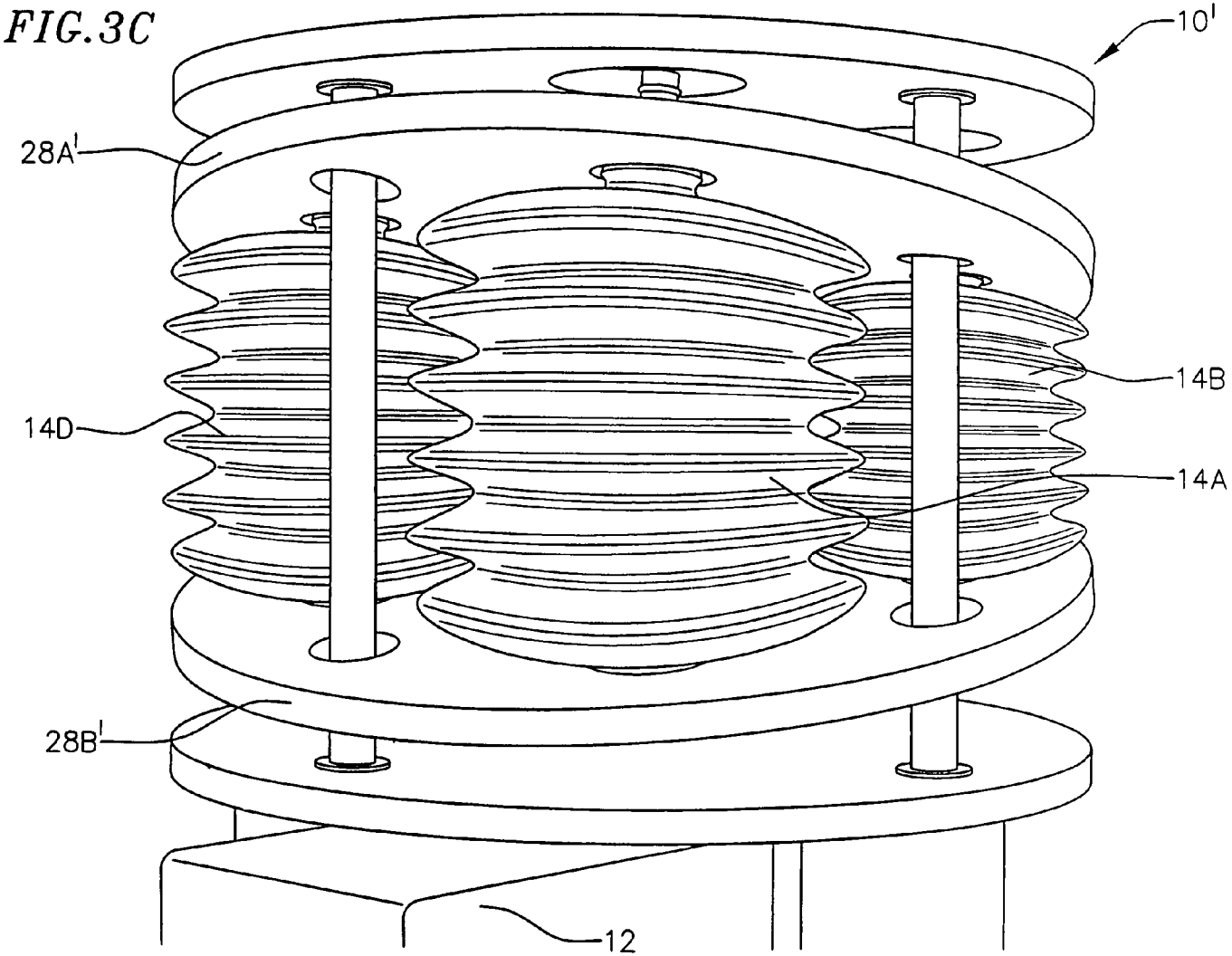
FIG. 3C is another perspective view of the four bellows air supply system of FIG. 3A, showing the first bellows in a partially retracted position.

FIGS. 3A–3C show an air supply system 10' according to another embodiment of the invention. The air supply system 10' of FIGS. 3A–3C operates as described above for the air supply system 10 of FIGS. 2A–2C. For example, the air supply system 10' of FIGS. 3A–3C includes a motor 12' that rotates an output shaft 26', and upper and lower plates 28A';28B' that are connected to the output shaft 26' by connectors 34'. The connectors 34' are oriented at an angle $\alpha'$, offset from a perpendicular orientation with respect to a longitudinal axis 25' of the output shaft 26'. In one embodiment, the plates 28A;28B wobble in opposite synchronization around the longitudinal axis 25' of the output shaft 26'.

One difference between the air supply system 10' of FIGS. 3A–3C and the air supply system 10 of FIGS. 2A–2C is that the air supply system 10' of FIGS. 3A–3C includes four bellows rather than two bellows. For example, in the embodiment shown in FIG. 3A, the air supply system 10 includes a first bellows 14A, a second bellows 14B that is adjacent to one side of the first bellows 14A, a forth bellows 14D that is adjacent to another side of the first bellows 14A and a third bellows 14C (not shown) that is laterally opposed or laterally aligned with the first bellows 14A.

In one embodiment, each time one of the bellows 14A;14B;14C;14D is in the retracted position, its laterally opposed bellows 14C;14D;14A;14B is in the extended position and its two adjacent bellows are in partially retracted positions. For example, in the illustration of FIG. 3A, the first bellows 14A is in the retracted position, the second and forth bellows 14B;14D are in partially retracted positions and the third bellows 14C is in the extended position.

As the air supply system 10' moves from the illustration shown in FIG. 3A to the illustration shown in FIG. 3B, the plates 28A';28B' move until the second bellows 14B is in the retracted position. When so positioned, the first and third bellows 14A;14C are moved to partially retracted positions and the forth bellows 14D is moved to the extended position.

As the air supply system 10' moves from the illustration shown in FIG. 3B to the illustration shown in FIG. 3C, the plates 28A';28B' move until the third bellows 14C is in the retracted position. When so positioned, the forth and second bellows 14D;14B are moved to partially retracted positions and the first bellows 14A is moved to the extended position.

The plates 28A';28B' cycle in this manner retracting the first bellows 14A, then the second bellows 14B, then the third bellows 14C, then the forth bellows 14D, then the first bellows 14A, etc.

In one embodiment, the air supply system 10' includes upper and lower stationary plates 52 and 54 having one or more rods 56 extending therebetween. Each rod is mounted to the stationary plates 52 and 54 and extends through openings or slots 58A;58B in the movable plates 28A;28B. Preferably, a pivoting slide bushing or bearing suspended in a noise dampening enclosure (such as a rubber bushing) is mounted at the interference of each rod 56 and slot 58A;58B. This arrangement minimizes noise resulting from the movement of the movable plates 28A;28B.

Although embodiments of an air supply system according to the present invention have been described as having two bellows and four bellows, in alternative embodiments the air supply system may include any appropriate number of bellows 14, such as one, three, five, six, seven, eight, etc.

Figure 9:
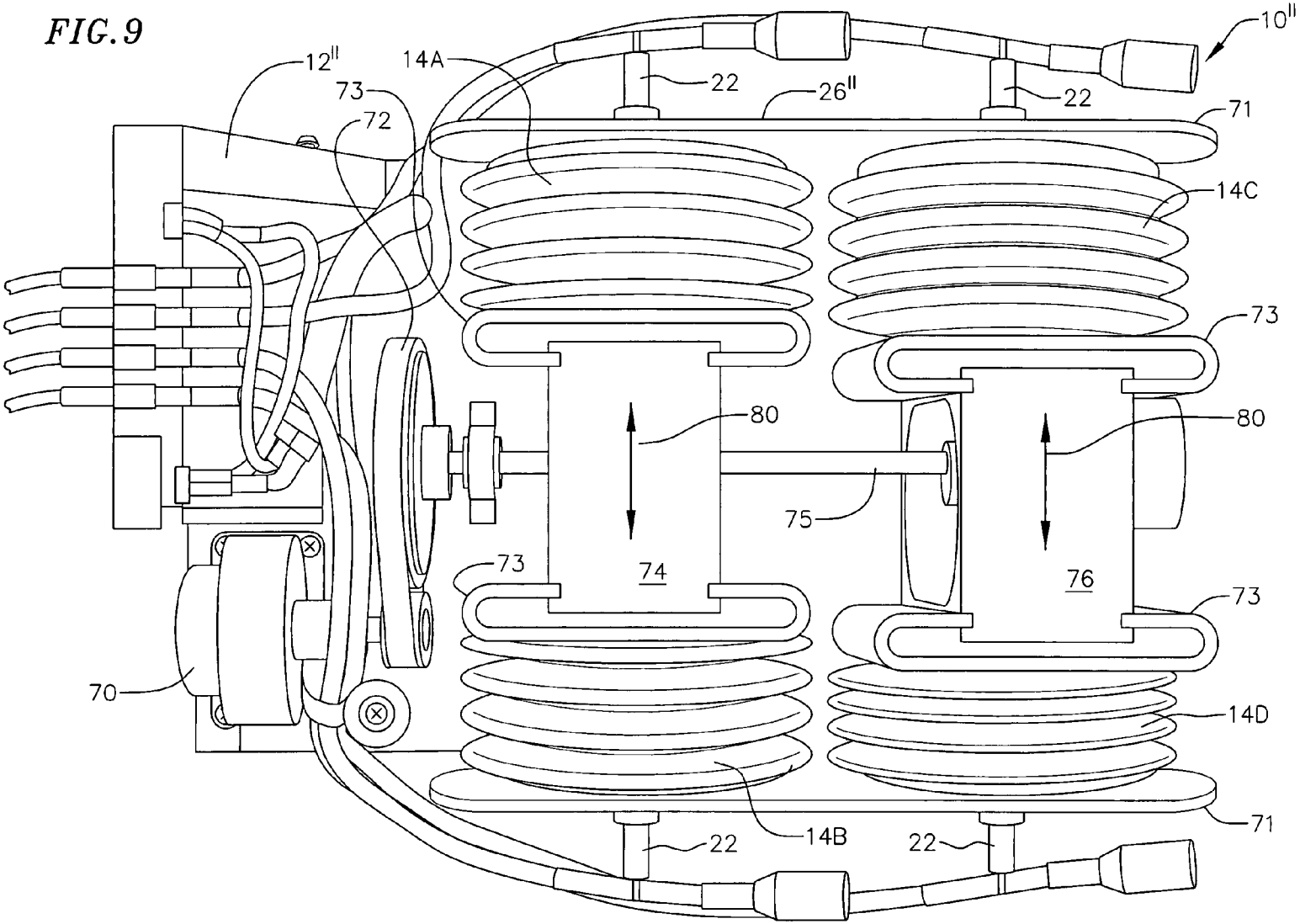
FIG. 9 is a top view of an air supply system according to one embodiment of the invention.

FIG. 9 shows another embodiment of a air supply system 10" according to the present invention. In this embodiment, a motor 12" rotates a worm drive speed reduction gear 70, which in turn drives a timing belt 72 that is connected to an output shaft 26". Alternatively, the motor 12" can be directly connected to the output shaft 26".

The air supply system 10" includes a plurality of bellows 14A–14D. Each bellows is connected at one end to a stationary plate 71 and at an opposite end to a mounting plate 73. In the depicted embodiment, each mounting plate 73 is a C-shaped plate. The air supply system 10" also includes a first sliding block 74 and a second sliding block 76. A first bellows 14A and a second bellows 14B are each connected to the first sliding block 74 by any suitably means, and a third bellows 14C and a fourth bellows 14D are each connected to the second sliding block 76 by any suitably means. In the depicted embodiment, the open end of each C-shaped plate is inserted into and affixed within a longitudinal slot in a corresponding one of the sliding blocks.

Each bellows is moveable between an extended position and a retracted position, wherein when each bellows is moved from the extended to the retracted position air is expelled from the bellows through conduit 22, and wherein when each bellows is moved from the retracted to the extended position air is taken into the bellows through conduit 22.

Figure 12:
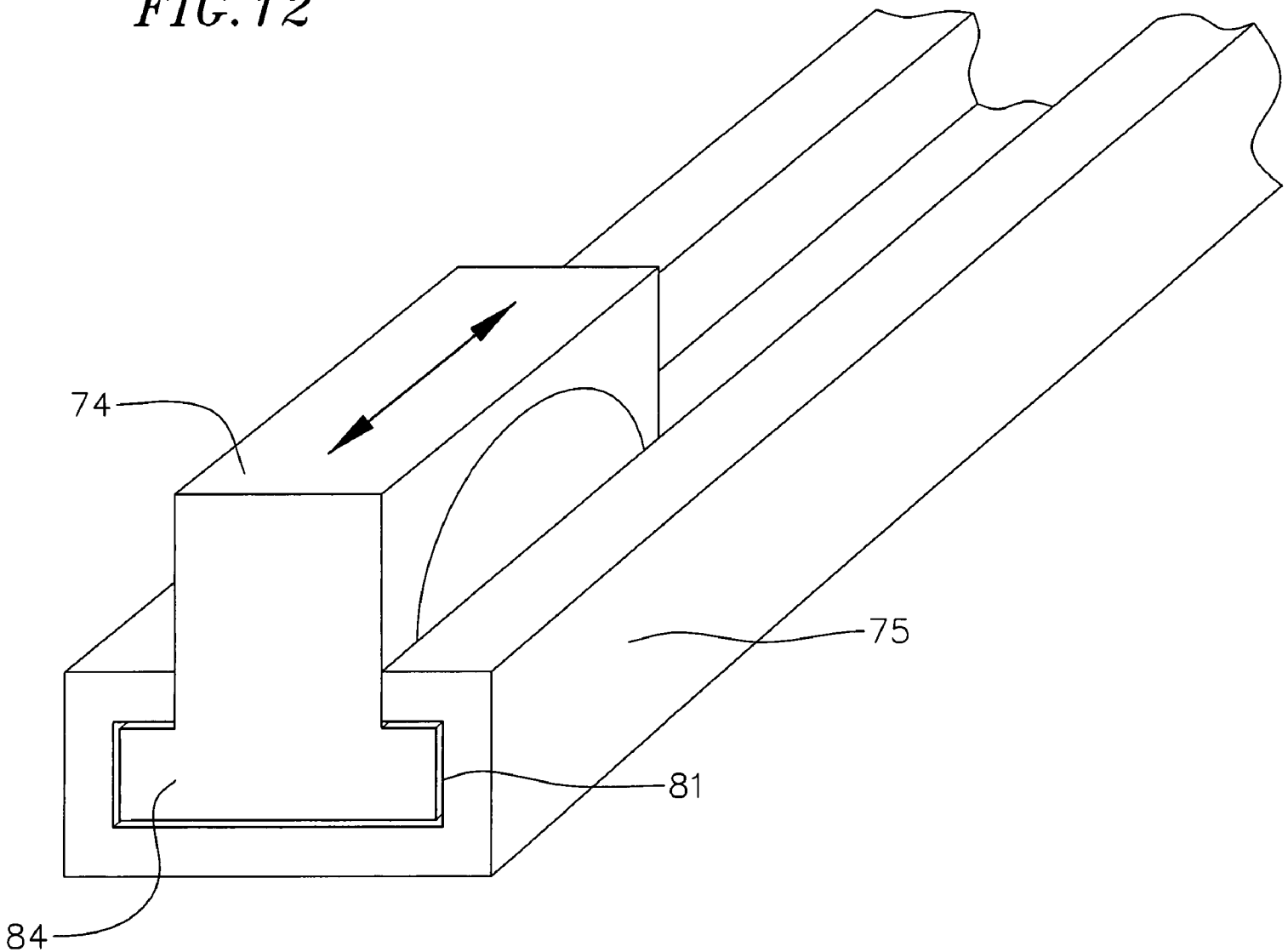
FIG. 12 is a perspective view of a locking engagement of a sliding block of the air supply system of FIG. 9 with a base plate of the air supply system of FIG. 9.

Each sliding block is laterally moveable. In one embodiment, such as that shown in FIG. 12, each sliding block is lockingly mounted in a base plate 75 of the air supply system 10" to ensure that each sliding block is only moveable in the lateral direction as depicted by arrows 80, and not movable in a vertical direction or a sideways direction. For example, as shown in FIG. 12, the base plate 75 includes a longitudinal slot 81 that receives an enlarged lower flange 84 of the first sliding block 74. Although not shown, the base plate 75 also includes a longitudinal slot that receives an enlarged lower flange of the second sliding block 76.

Figure 10:
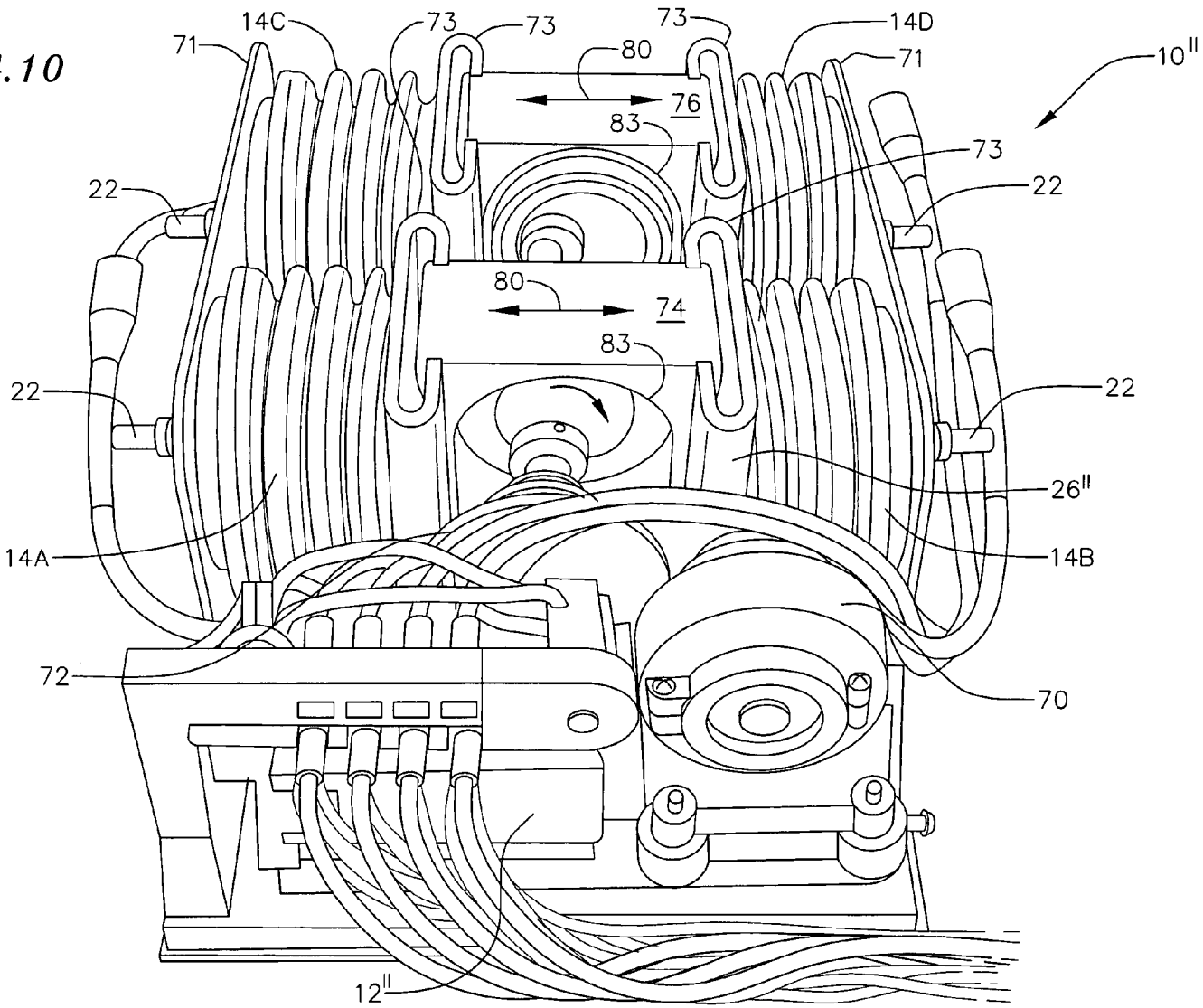
FIG. 10 is a perspective view of the air supply system of FIG. 9.
Figure 13:
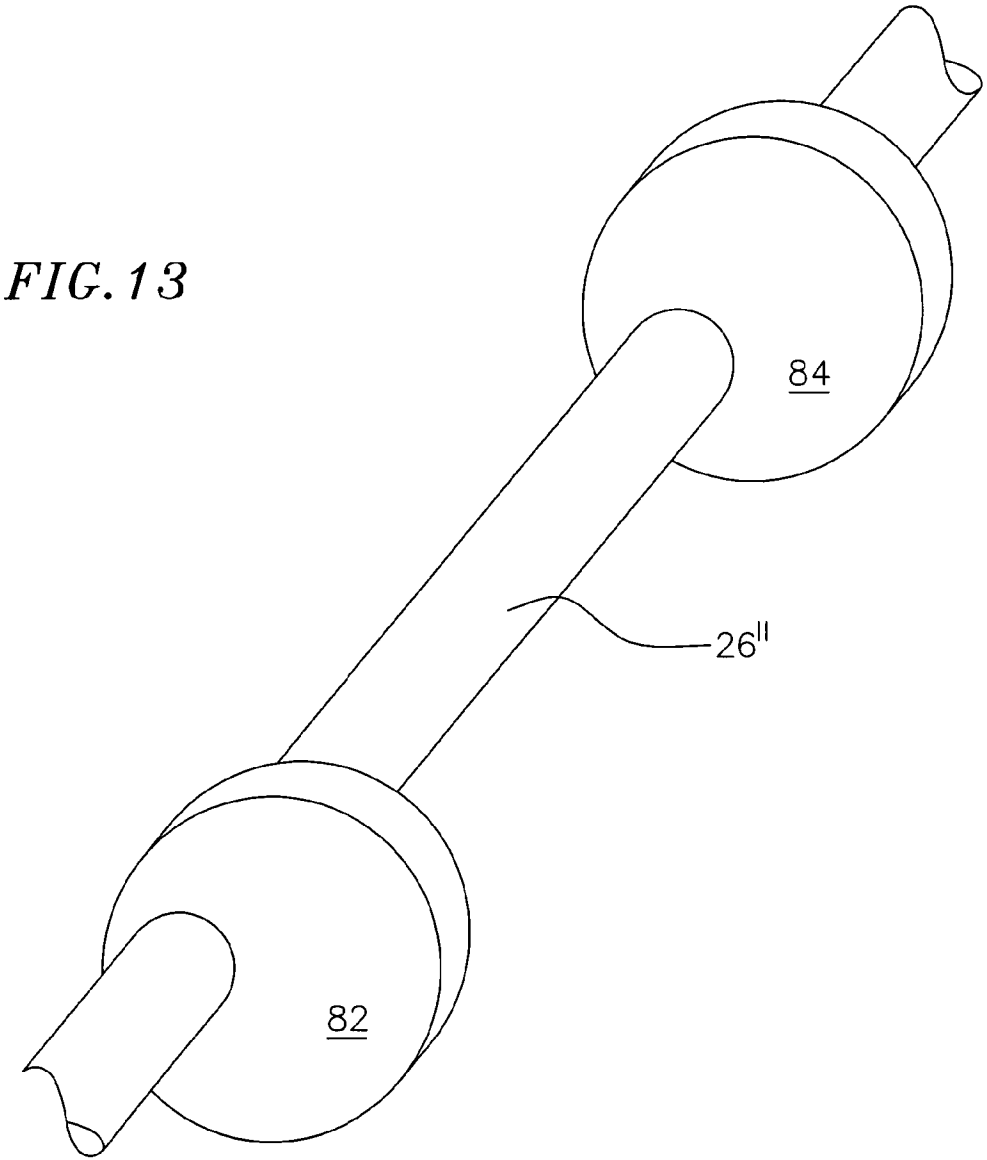
FIG. 13 is a perspective view of an output shaft having eccentrically mounting bearings for use in the air supply system of FIG. 9.

As shown in FIG. 10 the drive shaft 26" includes a first bearing 82 and a second bearing 84. Each bearing is eccentrically mounted on the drive shaft 26". For clarity, FIG. 13 shows the drive shaft" separated from the air supply system 10". In the depicted embodiment of FIG. 13, the bearings are offset ninety degrees with respect to each other, an advantage of which is described below.

Figure 11:
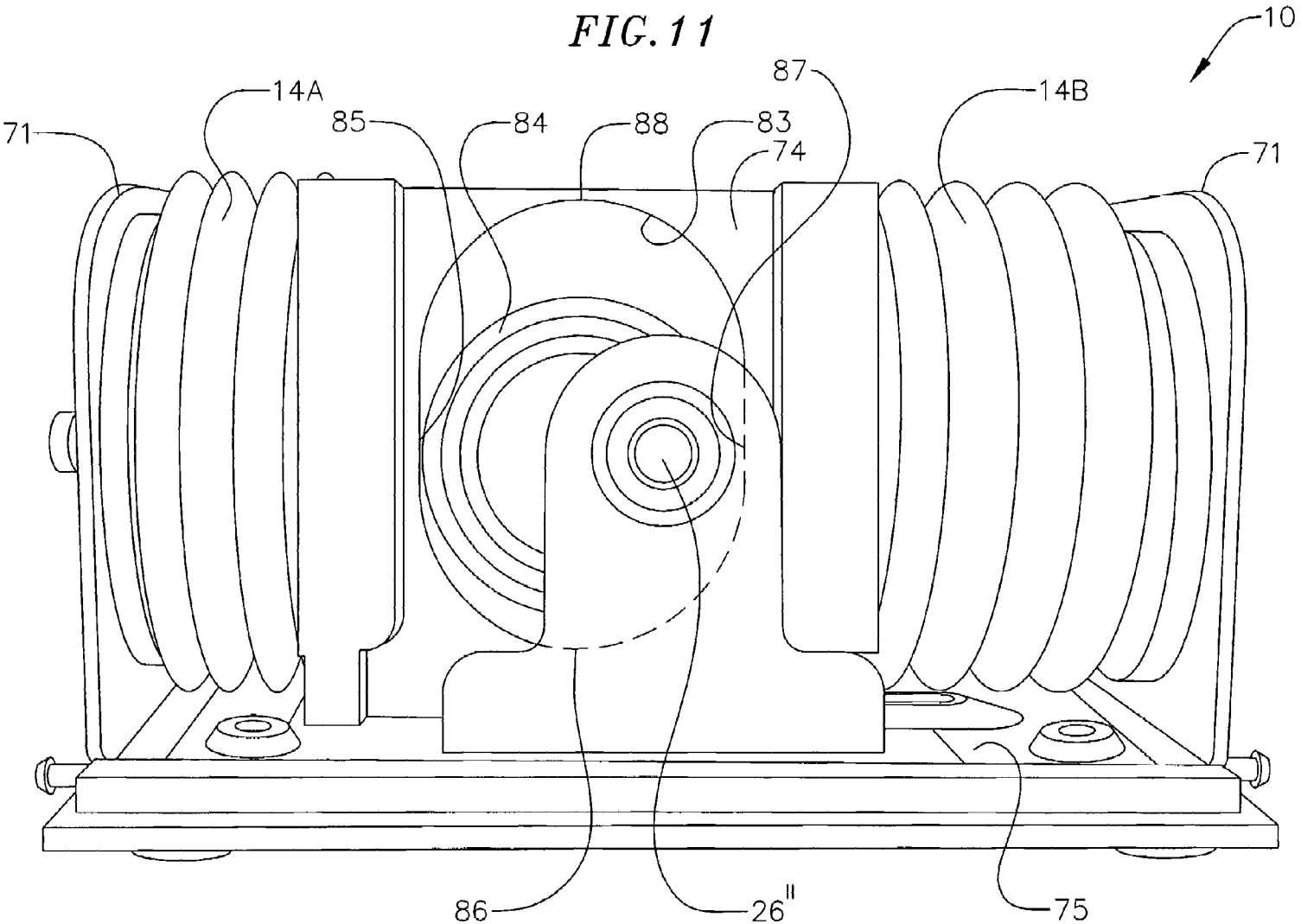
FIG. 11 is a side view of the air supply system of FIG. 9.

The eccentric movement of the bearings causes the lateral movement of the sliding blocks as depicted by arrows 80. For example, as shown in FIGS. 10 and 11, each sliding block includes a substantially elliptically shaped slot 83. As shown in FIG. 11, an outer sleeve 84 of the first bearing 82 is in contact with a first point 85 along the slot 83. In the position, the first bellows 14A is in the retracted position and the second bellows 14B is in the extended position.

Operation of the motor 12" causes the output shaft 26" to rotate as shown by arrow 89, this rotation causes the first bearing 82 to follow the path of the elliptically shaped slot 83. As the first bearing 82 moves from point 85 to point 86 along the slot 83, the first sliding block is moved to the right in FIG. 11, this causes the first bellows 14A to move from the retracted position to a partially extended position and the second bellows 14B to move from the extended position to a partially retracted position.

Continued operation of the motor 12" causes the first bearing 82 to moves from point 86 to point 87 along the slot 83, causing the first sliding block 74 to continue to move to the right in FIG. 11. This causes the first bellows 14A to move from the partially extended position to the extended position and the second bellows 14B to move from the partially retracted position to the retracted position.

Continued operation of the motor 12" causes the first bearing 82 to moves from point 87 to point 88 along the slot 83, causing the first sliding block 74 to move to the left in FIG. 11. This causes the first bellows 14A to move from the extended position to the partially retracted position and the second bellows 14B to move from the retracted position to the partially extended position.

Continued operation of the motor 12" causes the first bearing 82 to moves from point 88 to point 85 along the slot 83, causing the first sliding block 74 to continue to move to the left in FIG. 11. This causes the first bellows 14A to move from the partially retracted position to the retracted position and the second bellows 14B to move from the partially extended position to the extended position. Continued operation of the motor 12" causes the first bearing 82 to continually oscillate the first sliding block 74 in this manner.

In the same manner as that described above with respect to the first bearing 82, the second bearing 84 moves along the elliptically shaped slot 83 of the second sliding block 76 to laterally move the second slide block 76, causing the third and fourth bellows 14C and 14D to move between the extended and retracted positions.

In embodiments where the bearings are offset by approximately ninety degrees with respect to each other, each bellows is in a different stage of extension or retraction. For example, when the bearings are offset by approximately ninety degrees with respect to each other and the first bellows 14A is in the retracted position, the second bellows 14B is in the extended position, the third bellows 14C is in either the partially retracted or the partially extended position and the fourth bellows is in either the partially extended of the partially retracted position.

Figure 14:
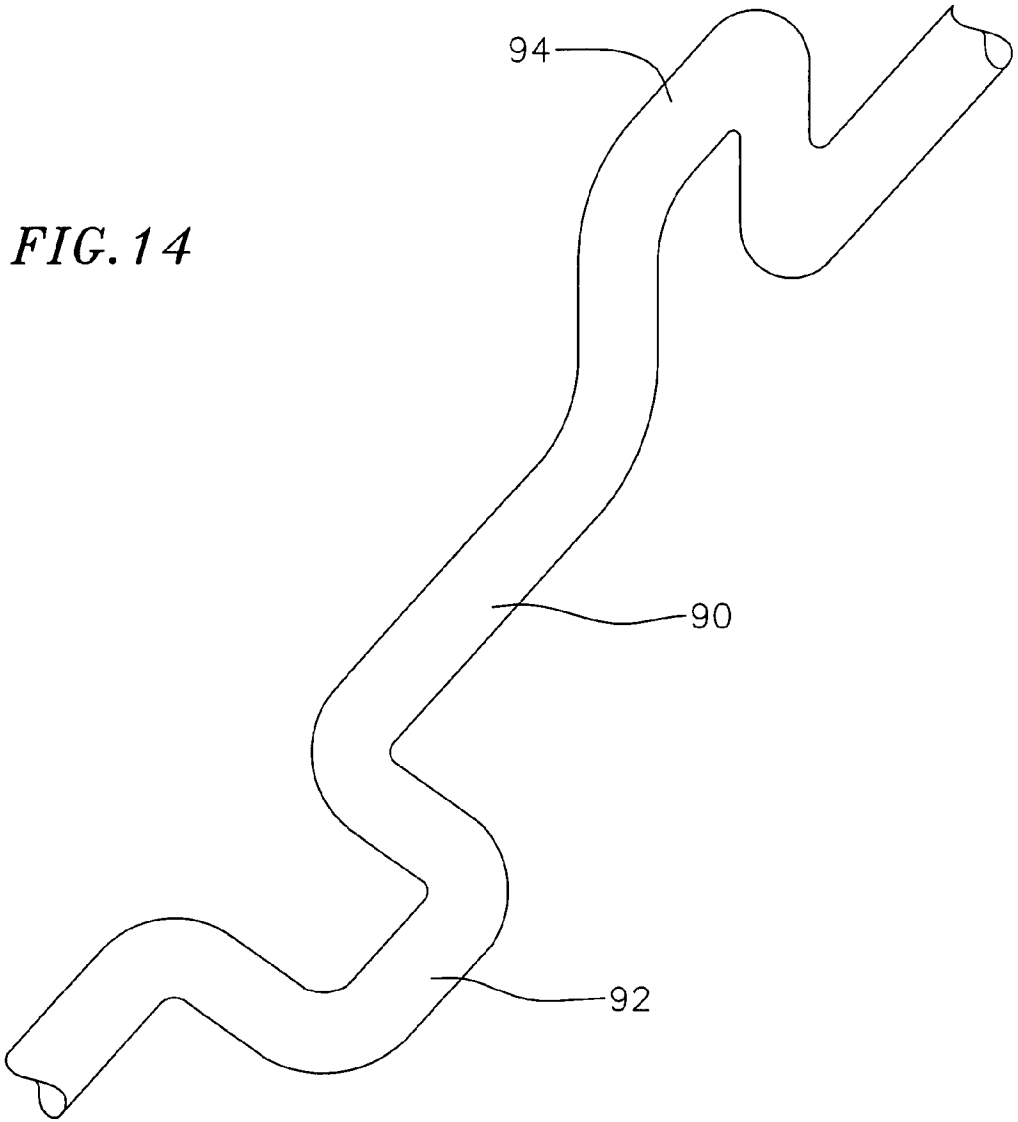
FIG. 14 is a perspective view of an alternative output shaft for use in the air supply system of FIG. 9.

FIG. 14 shows an alternate output shaft for use in the air supply system 10" depicted in FIGS. 9–11. The output shaft of FIG. 14 is a cam shaft 90 having a first cam 92 and a second cam 94. In the depicted embodiment the cams are offset by approximately ninety degrees with respect to each other. In one embodiment, the cam shaft 90 and cams 92 and 94 replace the output shaft 22" and the bearings 82 and 84 of the embodiment of FIGS. 9–13. In such an embodiment, the cams 92 and 94 operate to laterally move the sliding blocks 74 and 76 in the same manner as described above with respect to the bearings 82 and 84. In addition, as with the bearings 82 and 84, when the cams 92 and 94 are offset by approximately ninety degrees with respect to each other, each bellows is in a different stage or extension or retraction.

Although, the air supply system 10" of FIGS. 9–14 has been described as having four bellows, the air supply system 10" may have any other appropriate number of bellows, such as two, six or eight, among other appropriate numbers of bellows. In an embodiment of the air supply system 10" that includes two bellows, it is preferred that each bellows is connected to the one sliding block, such that when one bellows is in an extended position, the other bellows is in a retracted position and vice versa.

In an embodiment of the air supply system 10" that includes six bellows, it is preferred that the air supply system 10" includes three sliding blocks each having two bellows connected thereto and each being laterally moveable by a cam or bearing as described above. In this embodiment, it is preferred that each cam or bearing is offset by sixty degrees with respect to each other. This ensures that each of the six bellows is in a different stage of extension or retraction.

In an embodiment of the air supply system 10" that includes eight bellows, it is preferred that the air supply system 10" includes four sliding blocks each having two bellows connected thereto and each being laterally moveable by a cam or bearing as described above. In this embodiment, it is preferred that each cam or bearing is offset by ninety degrees with respect to each other. This ensures that a first grouping of the bellows contains four bellows that are each in a different stage of extension or retraction and a second grouping of the bellows contains four bellows that are each in a different stage of extension or retraction and a second.

Figure 7:
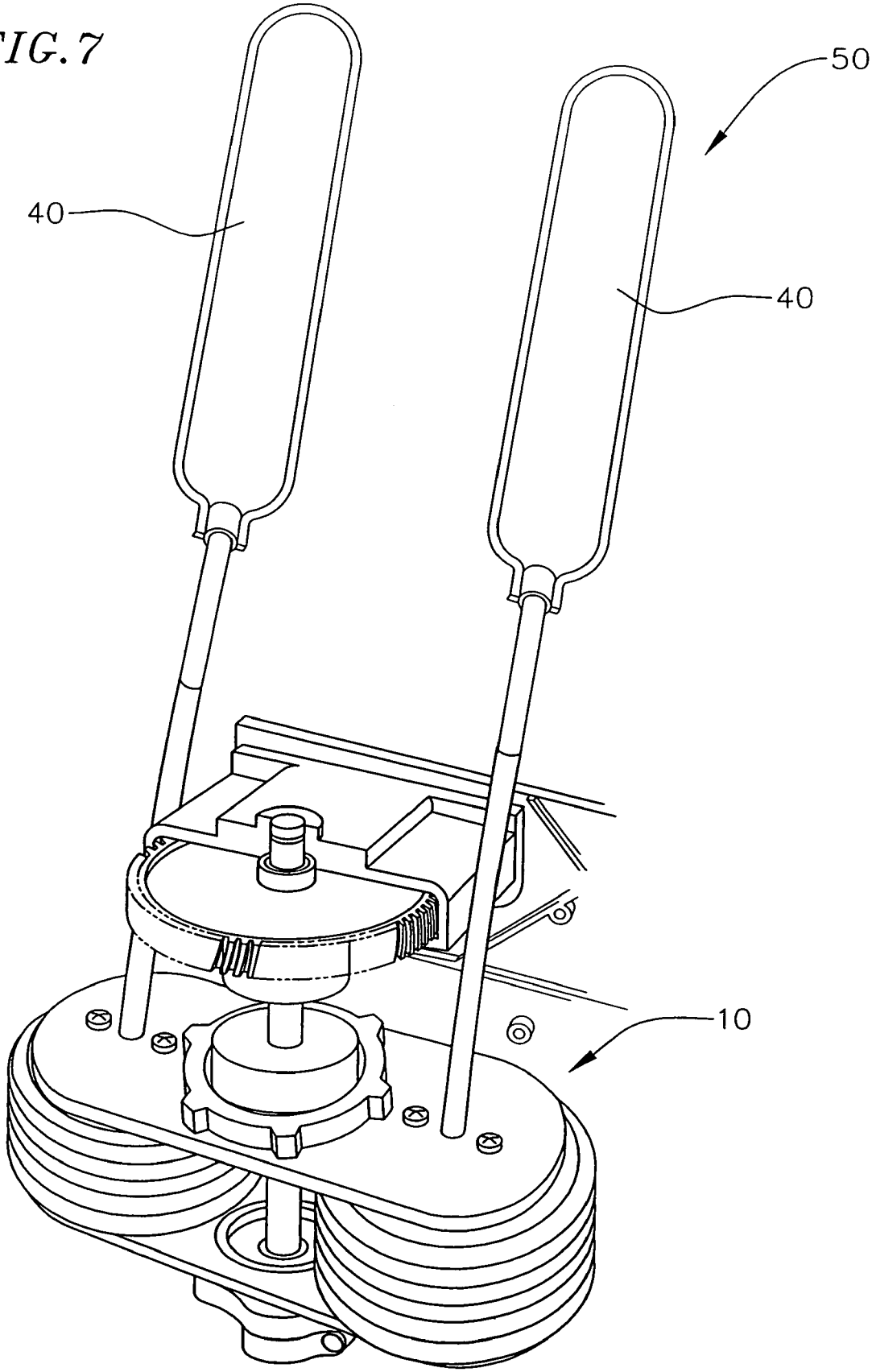
FIG. 7 is a perspective view of a massage system according to the present invention.

FIG. 7 shows a schematic representation of a massage system 50 according to one embodiment of the present invention. Although the massage system 50 is shown as including the air supply system 10, a massage system according to the present invention may include one or more of any of the air supply systems 10, 10' or 10" described above. In addition, the massage system 50 includes at least one inflatable balloon (FIGS. 4A–4B) connected to at least one of the bellows 14 of the one or more air supply systems.

Figure 4B:
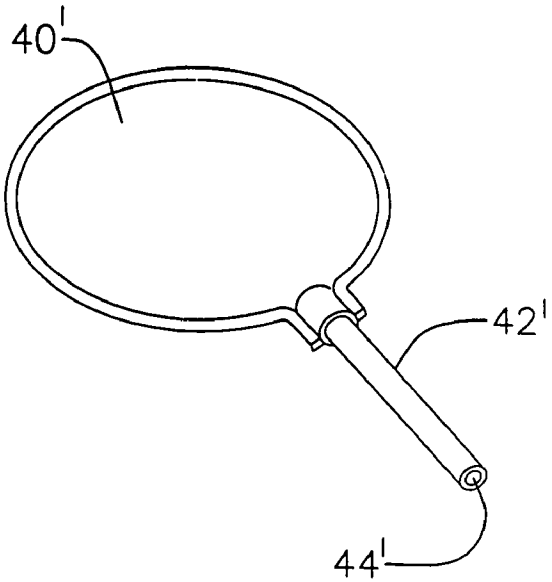
FIG. 4B is a perspective view of another exemplary inflatable bladder for attachment to a bellows of an air supply system according to the present invention; t
Figure 4A:
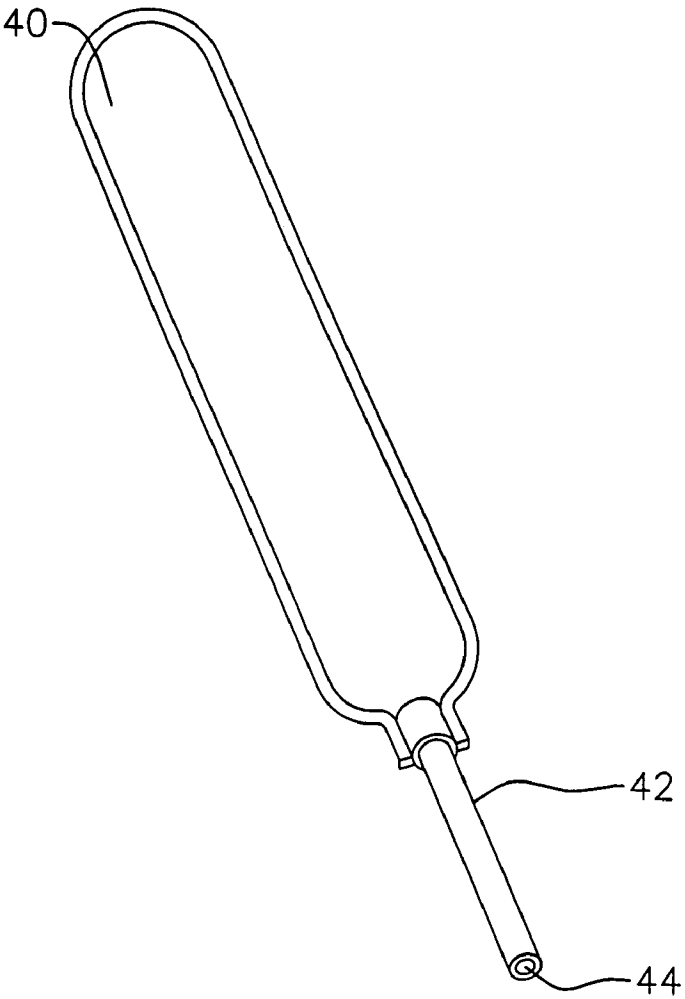
FIG. 4A is a perspective view of an exemplary inflatable bladder for attachment to a bellows of an air supply system according to the present invention.

FIG. 4A shows an exemplary inflatable bladder 40. The inflatable bladder 40 includes a conduit 42 having an opening 44. As previously discussed, at least one inflatable bladder 40 is connected to at least one of the bellows 14 of the one or more air supply systems to form the massage system 50. In such a massage system 50, when the bellows 14 is moved from the extended position to the retracted position air exits the bellows 14 through the opening 24 in the conduit 22 of the bellows 14 and travels through both the opening 44 and the conduit 42 of the inflatable bladder 40 and into the inflatable bladder 40 causing the inflatable bladder 40 to inflate or expand. Similarly, when the bellows 14 is moved from the retracted position to the extended position air is extracted from the inflatable bladder 40 and enters the bellows 14 causing the inflatable bladder 40 to deflate or retract.

In one embodiment, the conduit 22 of the bellows 14 and the conduit 42 of the inflatable bladder 40 form an air tight seal so that air does not leak therethrough. Such a connection can be made by use of an adhesive, by a heat weld or by use of another appropriate method.

As described above, each bellows 22 and its at least one inflatable bladder 40 connected thereto (via conduits 22;42) forms a bellows/bladder system that is a substantially closed. However, in one embodiment each bellows/bladder system includes a "bleed hole" for controlled leakage of air from the bellows/bladder system. The controlled leakage of air allows each bladder 40 to be slowly deflated for user comfort when the air supply system is not operating. The bleed hole may be located anywhere in the bellows/bladder system, such as in the bellows 22, in the bladder 40, or in one of the conduits 22;42.

Preferably, the bleed hole diameter is large enough to ensure a slow deflation of each bladder 40 over a reasonable period of time when the air supply system is not operating, yet small enough to not adversely affect the inflation rate of each bladder 40 when the air supply system is operating.

In another embodiment, each bellows/bladder system includes a check valve. The check valve may be installed directly in the bellows 22 or via an air tube so that the check valve may be positioned remote from the bellows/bladder system. The check valve ensures that the bellows/bladder system always contains a predetermined amount of air during each compression cycle (when the bellows 22 is moved from the extended to the retracted positions). For example, the predetermined amount of air may be an amount that fully inflates each bladder 40 during the compression cycle.

Absent the check valve, and in situations were the bladders 40 do not become completely inflated after the compression cycle, the bellows/bladder system becomes starved for air, resulting in damage to the pump. When the check valve is present and the bellows/bladder system becomes starved for air (for example, after the air supply system as been inoperable for a sufficient time to allow the bleed holes to deflate each of the bladders 40), the check valve opens and allows air to enter the bellows 22 during the extension cycle (when the bellows 22 is moved from the retracted to the extended positions). When the bellows begins the compression cycle, the check valve closes. In order to prevent undesired and/or inadvertent opening of the check valve, the check valve opening resistance is preferably slightly greater than the total air resistance in the path between the bellows 22 and the bladder 40. If the check valve opening resistance is not great enough, too much air may enter the bellows/bladder system resulting in an explosion of the bladder 40 and/or other pump components. In embodiments that include both the previously described check valves and bleed holes, the bleed holes may be disposed in the check valves or in any of the other locations for the bleed holes as described above.

FIG. 4B shows an inflatable bladder 40' that is generally spherical in shape when inflated. The inflatable bladder 40' of FIG. 4B includes a conduit 42' having an opening 44' as described above with respect to the inflatable bladder 40 of FIG. 4A. Each inflatable bladder 40 and 40' may be composed of a thin neoprene balloon, or another appropriate material. Although cylindrical and spherical inflatable bladders 40;40' have been described, in other embodiments inflatable bladders of any appropriate shape may be used.

The massage system 50 may include any appropriate number of inflatable bladders 40;40'. In addition, the massage system 50 may include inflatable bladders 40; 40' of the same shape and size or any permutation of different shapes and sizes.

Figure 5:
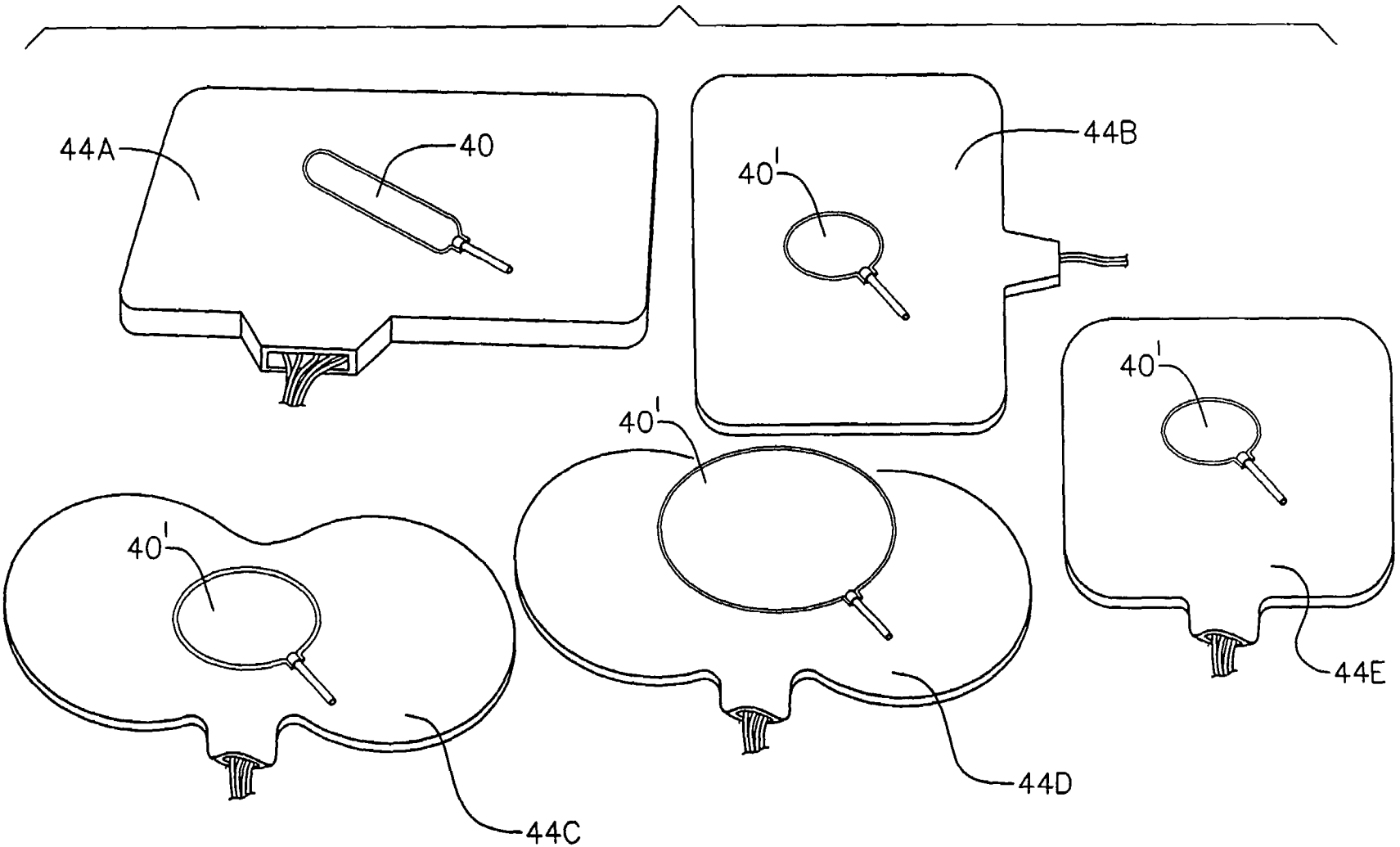
FIG. 5 is perspective views of various expandable pads for use in a massage system according to the present invention.

In one embodiment, the massage system 50 further includes an expandable pad, such as any of the pads 44A–44E shown in FIG. 5. Each pad 44A–44E may include an upper layer and a lower layer that are heat sealed together after one or more inflatable bladders 40 have been positioned as desired within the pad 44A–44E.

FIG. 5 shows various different shapes and sizes of pads 44A–44E. For clarity, in the illustrations of FIG. 5, exterior to each pad 44A–44E is an exemplary inflatable bladder 40; 40' that may be disposed within the pad 44A–44E. However, as noted above, the massage system 50 and hence the pad 44A–44E may contain inflatable bladders 40; 40' of the same shape and size or any permutation of different shapes and sizes, as well as any number of inflatable bladders 40.

Figure 6:
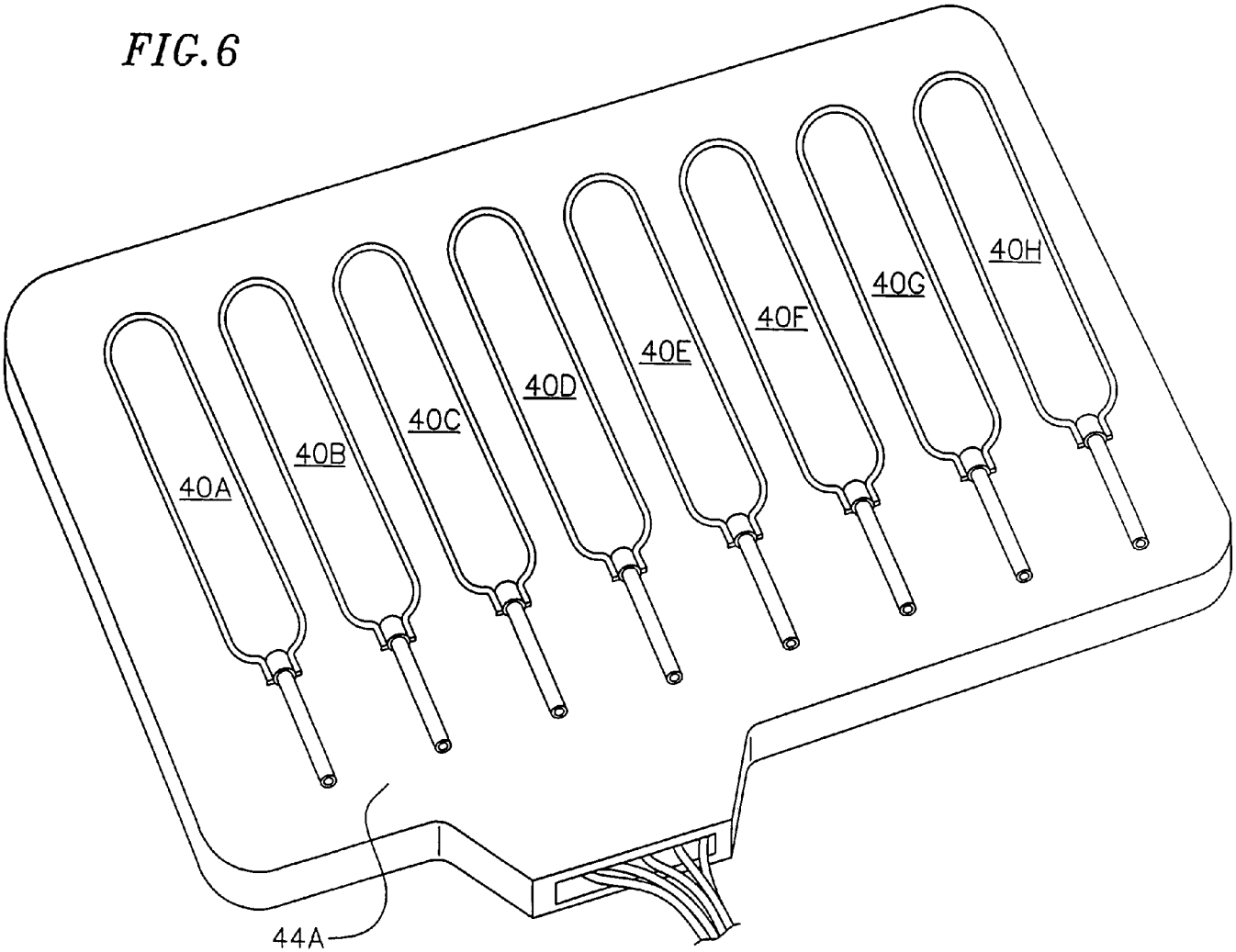
FIG. 6 is a perspective view of another expandable pads for use in a massage system according to the present invention.

In the embodiment of FIG. 6 the pad 44A includes eight cylindrical inflatable bladders 40A–40H disposed therein (the inflatable bladders 40A–40H are also shown exterior to the pad 44A for clarity). When the pad 44A of FIG. 6 is used in connection with the air supply system 10 of FIGS. 3A–3C a "T" shaped connector may be used to connect each bellows 14A–14D to any two of the inflatable bladders 40A–40H. The inflatable bladders 40A–40H can then be inflated and deflated in any appropriate pattern within the pad 44A.

For example, if a cascading pattern is desired, the first bellows 14A of the air supply system 10 can be connected to inflatable bladders 40A;40B, the second bellows 14B can be connected to inflatable bladders 40C;40D, the third bellows 14C can be connected to inflatable bladders 40E; 40F, and the forth bellows 14D can be connected to inflatable bladders 40G;40H. The result being that a repeating cycle of the inflatable bladders 40A;40B being inflated, followed by the inflatable bladders 40C;40D being inflated, followed by the inflatable bladders 40E;40F being inflated, followed by the inflatable bladders 40G;40H being inflated etc.

If, on the other hand, a wave pattern is desired, the first bellows 14A can be connected to inflatable bladders 40A; 40E, the second bellows 14B can be connected to inflatable bladders 40B;40F, the third bellows 14C can be connected to inflatable bladders 40C;40G, and the forth bellows 14D can be connected to inflatable bladders 40D;40H. Similarly, different massaging patterns can be created by varying the connections of the bellows 14 to the inflatable bladders 40. The result being that a repeating cycle of the inflatable bladders 40A;40E being inflated, followed by the inflatable bladders 40B;40F being inflated, followed by the inflatable bladders 40C;40G being inflated, followed by the inflatable bladders 40D;40H being inflated etc. Different massage sensations can also be created by varying the operational speed of the air supply system.

The air supply system described above offers advantages over prior art systems, such as piston pumps in that little to no maintenance is required of the air supply system. For example, the air supply system does not require maintenance such as adding lubrication, replacing piston rings, etc.

Figure 8:
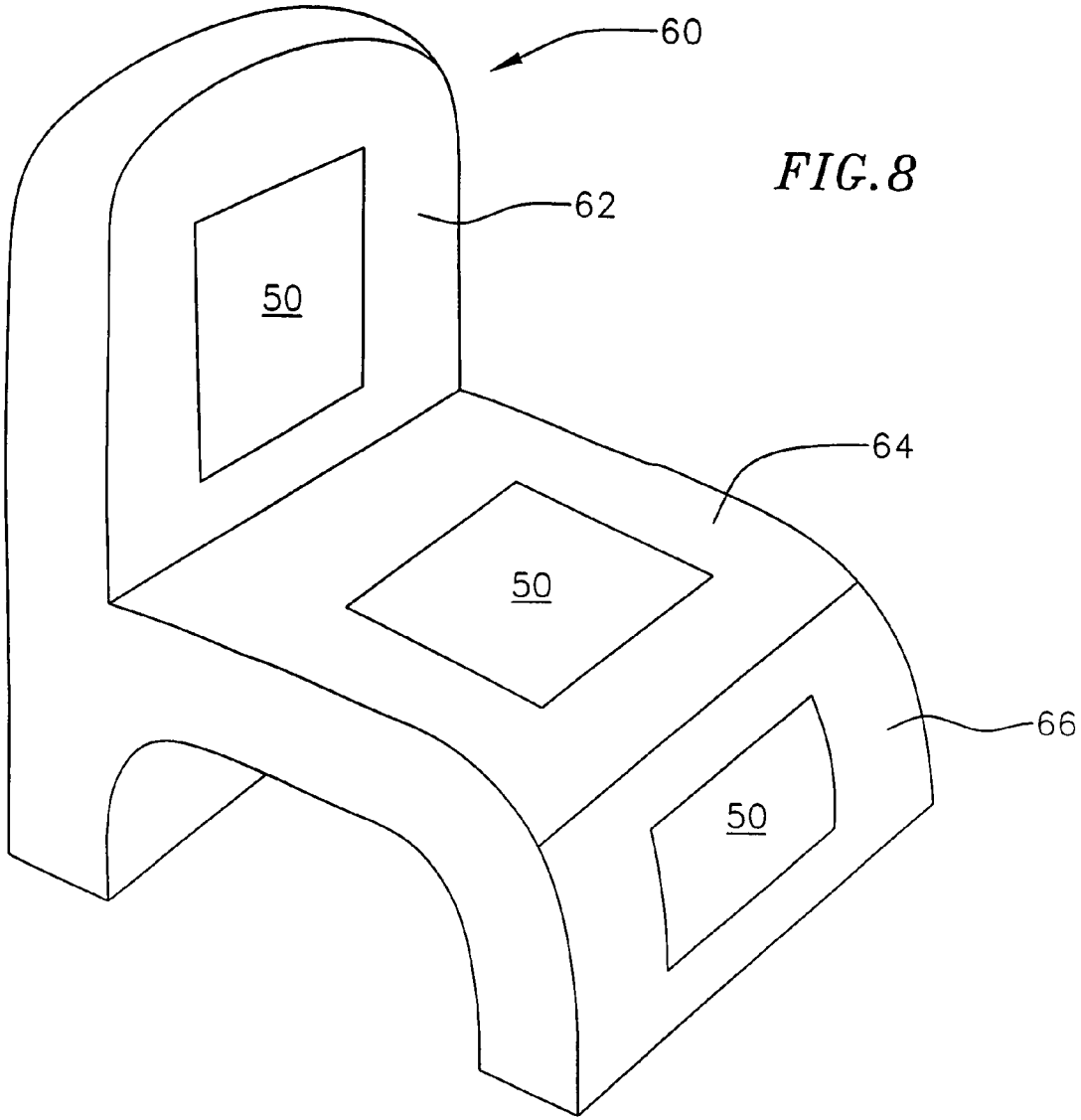
FIG. 8 is a perspective view of a massage chair according the present invention.

FIG. 8 shows a schematic representation of a massage chair 60 according to the present invention. The massage chair 60 may include one of more of the massage systems described above, having one or more of any of the air supply systems described above along with one or more of any of the inflatable bladders described above. The inflatable bladders may be contained within any of the expandable pads described above or the inflatable bladders may be otherwise disposed within or connected to the massage chair 60.

In the depicted embodiment, the massage chair 60 includes a back portion 62, a seat portion 64 and a leg portion 66. The massage chair 60 may include one or more of the massage systems 50 disposed in any one or all of the back portion 62, the seat portion 64 and the leg portion 66, as well as in any other appropriate portion of the massage chair 60.

The massage chair 60 according to the present invention has an advantage over some of the massage chairs of the prior art in that when the air supply system of each massage system 50 is not activated, each inflatable bladders 40 is deflated, due to the above described bleed hole. As such, when the massage system 50 is not activated the massage chair 60 has the contour of a normal chair, i.e. the inflatable bladders 40 only deflect the normal contour of the massage chair 60 when the massage system 50 that is connected to the inflatable bladder 40 is activated.

The preceding description has been presented with references to presently preferred embodiments of the invention. Persons skilled in the art and technology to which this invention pertains will appreciate that alterations and changes in the described structures and methods of operation can be practiced without meaningfully departing from the principle, spirit and scope of this invention. Accordingly, the foregoing description should not be read as pertaining only to the precise structures described and shown in the accompanying drawings.

By way of example, the invention is not limited to massage chairs but can be configured in various shapes and sizes for any type of massaging device, including leg and calf massagers, neck massagers, massage belts or other types of massagers.

What is claimed is:

1. A massage system comprising:

a motor having an output shaft;

at least one sliding block connected to the output shaft;

at least one bellows, such that each bellows is connected to a corresponding one of the sliding blocks and moveable between an extended position and a retracted position, wherein when each bellows is moved from the extended to the retracted position air is expelled from the bellows, and wherein when each bellows is moved from the retracted to the extended position air is taken into the bellows; and wherein operation of the motor causes each sliding block to move between a first position and a second position, such that in the first position each sliding block compresses a corresponding one of the bellows to the retracted position and in the second position each sliding block releases said corresponding one of the bellows to the extended position, and wherein the output shaft of the motor comprises at least one eccentrically mounted bearing, such that each bearing is connected to a corresponding one of the sliding blocks to move said corresponding one of the sliding blocks between the first and second positions.

2. The massage system of claim 1, wherein the at least one sliding block comprises a first sliding block and the at least one bellows comprises a first bellows and a second bellows each connected to the first sliding block.

3. The massage system of claim 2, wherein when the first sliding block is in the first position the first bellows is in the retracted position and the second bellows is in the extended position and wherein when the first sliding block is in the second position the first bellows is in the extended position and the second bellows is in the retracted position.

4. The massage system of claim 3, wherein the at least one sliding block comprises a second sliding block and the at least one bellows comprises a third bellows and a fourth bellows each connected to the second sliding block.

5. The massage system of claim 4, wherein when the second sliding block is in the first position the third bellows is in the retracted position and the fourth bellows is in the extended position and wherein when the second sliding block is in the second position the third bellows is in the extended position and the fourth bellows is in the retracted position.

6. The massage system of claim 1, wherein the output shaft of the motor comprises at least one eccentrically mounted bearing that rotates about a substantially elliptically shaped slot in a corresponding one of the sliding blocks to move said corresponding one of the sliding blocks between the first and second positions.

7. The massage system of claim 1, wherein the at least one sliding block comprises a first sliding block and a second block and wherein the output shaft of the motor comprises two eccentrically mounted bearings, such that each bearing is connected a corresponding one of the sliding blocks to move said corresponding one of the sliding blocks between the first and second positions.

8. The massage system of claim 1, wherein the at least one sliding block comprises a first sliding block and a second block and wherein the output shaft of the motor comprises two eccentrically mounted bearings that each rotate about a substantially elliptically shaped slot in a corresponding one of the sliding blocks to move said corresponding one of the sliding blocks between the first and second positions.

9. The massage system of claim 8, wherein the two eccentrically mounted bearings are offset by approximately ninety degrees with respect to each other.

10. The massage system of claim 1, further comprising at least one inflatable bladder connected to each bellows, such that when each bellows is moved from the extended to the retracted position air is expelled from the bellows and enters a corresponding one of the at least one inflatable bladders, and wherein when each bellows is moved from the retracted to the extended position air is extracted from said corresponding one of the at least one inflatable bladders and enters the bellows.

11. The massage system of claim 10, wherein at least one of bellows is connected to more than one inflatable bladder.

12. The massage system of claim 10, wherein at least one of the inflatable bladders is disposed within an expandable pad.

13. The massage system of claim 1, wherein the output shaft of the motor is a cam shaft that comprises at least one cam, such that each cam is connected a corresponding one of the sliding blocks to move said corresponding one of the sliding blocks between the first and second positions.

14. The massage system of claim 1, wherein the output shaft of the motor is a cam shaft that comprises at least one cam that rotates about a substantially elliptically shaped slot in a corresponding one of the sliding blocks to move said corresponding one of the sliding blocks between the first and second positions.

15. The massage system of claim 1, wherein the at least one sliding block comprises a first sliding block and a second block and wherein the output shaft of the motor is a cam shaft that comprises two cams, such that each cam is connected a corresponding one of the sliding blocks to move said corresponding one of the sliding blocks between the first and second positions.

16. The massage system of claim 1, wherein the at least one sliding block comprises a first sliding block and a second block and wherein the output shaft of the motor is a cam shaft that comprises two cams that each rotate about a substantially elliptically shaped slot in a corresponding one of the sliding blocks to move said corresponding one of the sliding blocks between the first and second positions.

17. The massage system of claim 16, wherein the two cams are offset by approximately ninety degrees with respect to each other.

18. A massage system comprising:

a motor having an output shaft;

at least one sliding block, wherein each sliding block is movable between a first position and a second position;

at least one bellows, such that each bellows is connected to a corresponding one of the sliding blocks and moveable between an extended position and a retracted position, wherein when each bellows is moved from the extended to the retracted position air is expelled from the bellows, and wherein when each bellows is moved from the retracted to the extended position air is taken into the bellows;

wherein the at least one sliding block comprises a first sliding block and the at least one bellows comprises a first bellows and a second bellows each connected to the first sliding block;

a first bearing eccentrically mounted on the output shaft of the motor, wherein operation of the motor causes the first bearing to rotate about a substantially elliptically shaped slot in the first sliding block, causing the first sliding block to move between the first and second positions; and wherein when the first sliding block is in the first position the first bellows is in the retracted position and the second bellows is in the extended position and wherein when the first sliding block is in the second position the first bellows is in the extended position and the second bellows is in the retracted position.

19. The massage system of claim 18 wherein:

the at least one sliding block comprises a second sliding block and the at least one bellows comprises a third bellows and a forth bellows each connected to the second sliding block;

the massage system further comprises a second bearing eccentrically mounted on the output shaft of the motor, such that operation of the motor causes the second bearing to rotate about a substantially elliptically shaped slot in the second sliding block, causing the third sliding block to move between the first and second positions; and when the second sliding block is in the first position the third bellows is in the retracted position and the fourth bellows is in the extended position and wherein when the second sliding block is in the second position the third bellows is in the extended position and the fourth bellows is in the retracted position.

20. A massage system comprising:

a motor having an output shaft that is a cam shaft;

at least one sliding block, wherein each sliding block is movable between a first position and a second position;

at least one bellows, such that each bellows is connected to a corresponding one of the sliding blocks and moveable between an extended position and a retracted position, wherein when each bellows is moved from the extended to the retracted position air is expelled from the bellows, and wherein when each bellows is moved from the retracted to the extended position air is taken into the bellows;

wherein the at least one sliding block comprises a first sliding block and the at least one bellows comprises a first bellows and a second bellows each connected to the first sliding block;

wherein operation of the motor causes a first cam on the cam shaft to rotate about a substantially elliptically shaped slot in the first sliding block, causing the first sliding block to move between the first and second positions; and wherein when the first sliding block is in the first position the first bellows is in the retracted position and the second bellows is in the extended position and wherein when the first sliding block is in the second position the first bellows is in the extended position and the second bellows is in the retracted position.

21. The massage system of claim 20 wherein:

the at least one sliding block comprises a second sliding block and the at least one bellows comprises a third bellows and a forth bellows each connected to the second sliding block;

operation of the motor causes a second cam on the cam shaft to rotate about a substantially elliptically shaped slot in the second sliding block, causing the third sliding block to move between the first and second positions; and when the second sliding block is in the first position the third bellows is in the retracted position and the fourth bellows is in the extended position and wherein when the second sliding block is in the second position the third bellows is in the extended position and the fourth bellows is in the retracted position.

22. A massage system comprising:

a motor having an output shaft;

at least one sliding block connected to the output shaft;

at least one bellows, such that each bellows is connected to a corresponding one of the sliding blocks and moveable between an extended position and a retracted position, wherein when each bellows is moved from the extended to the retracted position air is expelled from the bellows, and wherein when each bellows is moved from the retracted to the extended position air is taken into the bellows; and wherein operation of the motor causes each sliding block to move between a first position and a second position, such that in the first position each sliding block compresses a corresponding one of the bellows to the retracted position and in the second position each sliding block releases said corresponding one of the bellows to the extended position, wherein the output shaft of the motor comprises at least one eccentrically mounted bearing that rotates about a substantially elliptically shaped slot in a corresponding one of the sliding blocks to move said corresponding one of the sliding blocks between the first and second positions.

23. A massage system comprising:

a motor having an output shaft;

at least one sliding block connected to the output shaft;

at least one bellows, such that each bellows is connected to a corresponding one of the sliding blocks and moveable between an extended position and a retracted position, wherein when each bellows is moved from the extended to the retracted position air is expelled from the bellows, and wherein when each bellows is moved from the retracted to the extended position air is taken into the bellows; and wherein operation of the motor causes each sliding block to move between a first position and a second position, such that in the first position each sliding block compresses a corresponding one of the bellows to the retracted position and in the second position each sliding block releases said corresponding one of the bellows to the extended position, wherein the at least one sliding block comprises a first sliding block and a second block and wherein the output shaft of the motor comprises two eccentrically mounted bearings, such that each bearing is connected a corresponding one of the sliding blocks to move said corresponding one of the sliding blocks between the first and second positions.

24. A massage system comprising:

a motor having an output shaft;

at least one sliding block connected to the output shaft;

at least one bellows, such that each bellows is connected to a corresponding one of the sliding blocks and moveable between an extended position and a retracted position, wherein when each bellows is moved from the extended to the retracted position air is expelled from the bellows, and wherein when each bellows is moved from the retracted to the extended position air is taken into the bellows; and wherein operation of the motor causes each sliding block to move between a first position and a second position, such that in the first position each sliding block compresses a corresponding one of the bellows to the retracted position and in the second position each sliding block releases said corresponding one of the bellows to the extended position, wherein the at least one sliding block comprises a first sliding block and a second block and wherein the output shaft of the motor comprises two eccentrically mounted bearings that each rotate about a substantially elliptically shaped slot in a corresponding one of the sliding blocks to move said corresponding one of the sliding blocks between the first and second positions.

25. The massage system of claim 24, wherein the two eccentrically mounted bearings are offset by approximately ninety degrees with respect to each other.

26. A massage system comprising:

a motor having an output shaft;

at least one sliding block connected to the output shaft;

at least one bellows, such that each bellows is connected to a corresponding one of the sliding blocks and moveable between an extended position and a retracted position, wherein when each bellows is moved from the extended to the retracted position air is expelled from the bellows, and wherein when each bellows is moved from the retracted to the extended position air is taken into the bellows; and wherein operation of the motor causes each sliding block to move between a first position and a second position, such that in the first position each sliding block compresses a corresponding one of the bellows to the retracted position and in the second position each sliding block releases said corresponding one of the bellows to the extended position, further comprising at least one inflatable bladder connected to each bellows, such that when each bellows is moved from the extended to the retracted position air is expelled from the bellows and enters a corresponding one of the at least one inflatable bladders, and wherein when each bellows is moved from the retracted to the extended position air is extracted from said corresponding one of the at least one inflatable bladders and enters the bellows.

27. The massage system of claim 26, wherein at least one of bellows is connected to more than one inflatable bladder.

28. The massage system of claim 26, wherein at least one of the inflatable bladders is disposed within an expandable pad.

29. A massage system comprising:

a motor having an output shaft;

at least one sliding block connected to the output shaft;

at least one bellows, such that each bellows is connected to a corresponding one of the sliding blocks and moveable between an extended position and a retracted position, wherein when each bellows is moved from the extended to the retracted position air is expelled from the bellows, and wherein when each bellows is moved from the retracted to the extended position air is taken into the bellows; and wherein operation of the motor causes each sliding block to move between a first position and a second position, such that in the first position each sliding block compresses a corresponding one of the bellows to the retracted position and in the second position each sliding block releases said corresponding one of the bellows to the extended position, wherein the output shaft of the motor is a cam shaft that comprises at least one cam that rotates about, a substantially elliptically shaped slot in a corresponding one of the sliding blocks to move said corresponding one of the sliding blocks between the first and second positions.

30. A massage system comprising:

a motor having an output shaft;

at least one sliding block connected to the output shaft;

at least one bellows, such that each bellows is connected to a corresponding one of the sliding blocks and moveable between an extended position and a retracted position, wherein when each bellows is moved from the extended to the retracted position air is expelled from the bellows, and wherein when each bellows is moved from the retracted to the extended position air is taken into the bellows; and wherein operation of the motor causes each sliding block to move between a first position and a second position, such that in the first position each sliding block compresses a corresponding one of the bellows to the retracted position and in the second position each sliding block releases said corresponding one of the bellows to the extended position, wherein the at least one sliding block comprises a first sliding block and a second block and wherein the output shaft of the motor is a cam shaft that comprises two cams that each rotate about a substantially elliptically shaped slot in a corresponding one of the sliding blocks to move said corresponding one of the sliding blocks between the first and second positions.

31. The massage system of claim 30, wherein the two cams are offset by approximately ninety degrees with respect to each other.

* * * * *

UNITED STATES PATENT AND TRADEMARK OFFICE

CERTIFICATE OF CORRECTION

PATENT NO. : 7,207,958 B2
APPLICATION NO. : 10/751031
DATED : April 24, 2007
INVENTOR(S) : Dehli It is certified that error appears in the above-identified patent and that said Letters Patent is hereby corrected as shown below:

In the Claims

| | |
|---|---|
| Column 12, line 30, Claim 7 | After "connected",<br>Insert --to-- |
| Column 12, line 59, Claim 13 | After "connected",<br>Insert --to-- |
| Column 13, line 5, Claim 15 | After "connected",<br>Insert --to-- |
| Column 13, line 49, Claim 19 | Delete "forth",<br>Insert --fourth-- |
| Column 14, line 27, Claim 21 | Delete "forth",<br>Insert --fourth-- |
| Column 16, line 33, Claim 29 | Delete "about,",<br>Insert --about-- |

Signed and Sealed this

Twentieth Day of November, 2007

JON W. DUDAS
*Director of the United States Patent and Trademark Office*